US010898042B2

(12) United States Patent
Thorne et al.

(10) Patent No.: US 10,898,042 B2
(45) Date of Patent: Jan. 26, 2021

(54) ROBOTIC VACUUM

(71) Applicant: SHARKNINJA OPERATING LLC, Needham, MA (US)

(72) Inventors: Jason B. Thorne, Dover, MA (US); Daniel R. Der Marderosian, Westwood, MA (US); Charles Brunner, North Reading, MA (US); Dan Gutierrez, Needham, MA (US); Isaku Douglas Kamada, Brighton, MA (US); Rain Gu, Suzhou (CN); Ming Yao, Suzhou (CN); Heliang Chen, Suzhou (CN); Frederick K. Hopke, Medway, MA (US)

(73) Assignee: SharkNinja Operating LLC, Needham, MA (US)

( * ) Notice: Subject to any disclaimer, the term of this patent is extended or adjusted under 35 U.S.C. 154(b) by 211 days.

(21) Appl. No.: 15/998,594

(22) Filed: Aug. 16, 2018

(65) Prior Publication Data

US 2019/0090705 A1 Mar. 28, 2019

Related U.S. Application Data

(60) Provisional application No. 62/546,520, filed on Aug. 16, 2017.

(51) Int. Cl.
*A47L 9/04* (2006.01)

(52) U.S. Cl.
CPC ..... *A47L 9/0466* (2013.01); *A47L 9/0411* (2013.01); *A47L 9/0477* (2013.01); *A47L 9/0488* (2013.01); *A47L 2201/00* (2013.01)

(58) Field of Classification Search
CPC .. A47L 2201/00; A47L 9/0411; A47L 9/0466; A47L 9/0477; A47L 9/0488
See application file for complete search history.

(56) References Cited

U.S. PATENT DOCUMENTS

| | | | |
|---|---|---|---|
| 1,706,039 | A | 3/1929 | Owen |
| 2,241,775 | A | 5/1941 | Forsberg |
| 3,319,278 | A | 5/1967 | Frazer |
| 3,744,077 | A | 7/1973 | Smyth |
| 3,748,679 | A | 7/1973 | Rosendall |
| 3,750,215 | A | 8/1973 | Liebscher |
| 3,978,539 | A | 9/1976 | Yonkers |
| 4,403,372 | A | 9/1983 | Keane et al. |
| 5,208,521 | A | 5/1993 | Aoyama |

(Continued)

FOREIGN PATENT DOCUMENTS

| | | | |
|---|---|---|---|
| CN | 104248397 | 12/2014 | |
| DE | 102007060750 A1 * | 6/2009 | ..... A47L 9/0455 |

(Continued)

OTHER PUBLICATIONS

US 8,272,092 B2, 09/2012, Schnittman et al. (withdrawn)

(Continued)

*Primary Examiner* — Marc Carlson
(74) *Attorney, Agent, or Firm* — Grossman Tucker Perreault & Pfleger, PLLC

(57) ABSTRACT

A robotic cleaning apparatus can include a body and at least one antenna extending from a periphery of the body. The at least one antenna can be configured to rotate about an axis that extends substantially parallel to a surface to be cleaned.

18 Claims, 21 Drawing Sheets

(56) References Cited

U.S. PATENT DOCUMENTS

| | | | |
|---|---|---|---|
| 5,272,785 | A | 12/1993 | Stegens |
| 5,309,601 | A | 5/1994 | Hampton et al. |
| 5,341,540 | A | 8/1994 | Soupert et al. |
| 5,347,678 | A | 9/1994 | Williams et al. |
| 5,373,603 | A | 10/1994 | Stegens |
| 5,452,490 | A | 9/1995 | Brundula et al. |
| 5,465,451 | A | 11/1995 | Stegens |
| 5,481,515 | A | 1/1996 | Kando et al. |
| 5,890,250 | A | 4/1999 | Lange et al. |
| 6,226,832 | B1 | 5/2001 | McCormick |
| 6,314,611 | B1 | 11/2001 | Sauers |
| 6,324,714 | B1 | 12/2001 | Walz et al. |
| 6,591,441 | B2 | 7/2003 | Stegens et al. |
| 6,810,559 | B2 | 11/2004 | Mertes et al. |
| 6,848,147 | B2 | 2/2005 | Syverson et al. |
| 6,883,201 | B2 | 4/2005 | Jones et al. |
| 6,971,140 | B2 | 12/2005 | Kim |
| 7,152,267 | B2 | 12/2006 | Kaleta |
| 7,185,396 | B2 | 3/2007 | Im et al. |
| 7,243,393 | B2 | 7/2007 | Matusz et al. |
| 7,343,221 | B2 | 3/2008 | Ann |
| 7,448,113 | B2 | 11/2008 | Jones et al. |
| 7,571,511 | B2 | 8/2009 | Jones et al. |
| 7,636,982 | B2 | 12/2009 | Jones et al. |
| 7,673,367 | B2 | 3/2010 | Kim et al. |
| 7,827,653 | B1 | 11/2010 | Liu et al. |
| 8,011,050 | B2 | 9/2011 | Knopow |
| 8,032,985 | B2 | 10/2011 | Seo |
| 8,087,117 | B2 | 1/2012 | Kapoor et al. |
| 8,117,714 | B2 | 2/2012 | Nguyen et al. |
| 8,239,992 | B2 | 8/2012 | Schnittman et al. |
| 8,250,704 | B2 | 8/2012 | Yoo |
| 8,347,444 | B2 | 1/2013 | Schnittman et al. |
| 8,370,985 | B2 | 2/2013 | Schnittman et al. |
| 8,402,601 | B2 | 3/2013 | Fahlström |
| 8,418,303 | B2 | 4/2013 | Kapoor et al. |
| 8,438,695 | B2 | 5/2013 | Gilbert, Jr. et al. |
| 8,443,477 | B2 | 5/2013 | Jang et al. |
| 8,474,090 | B2 | 7/2013 | Jones et al. |
| 8,646,984 | B2 | 2/2014 | Gagnon |
| 8,656,544 | B1 | 2/2014 | Anderson |
| 8,656,550 | B2 | 2/2014 | Jones et al. |
| 8,661,605 | B2 | 3/2014 | Svendsen et al. |
| 8,671,507 | B2 | 3/2014 | Jones et al. |
| 8,695,144 | B2 | 4/2014 | Jang et al. |
| 8,720,001 | B2 | 5/2014 | Courtney et al. |
| 8,741,013 | B2 | 6/2014 | Swett et al. |
| 8,763,199 | B2 | 7/2014 | Jones et al. |
| 8,800,107 | B2 | 8/2014 | Blouin |
| 8,826,493 | B2 | 9/2014 | Stegens |
| 8,832,902 | B2 | 9/2014 | Kim et al. |
| 8,839,477 | B2 | 9/2014 | Schnittman et al. |
| 8,855,914 | B1 | 10/2014 | Alexander et al. |
| 8,881,339 | B2 | 11/2014 | Gilbert, Jr. et al. |
| 8,903,589 | B2 | 12/2014 | Sofman et al. |
| 8,910,342 | B2 | 12/2014 | Gilbert, Jr. et al. |
| 8,955,192 | B2 | 2/2015 | Gilbert, Jr. et al. |
| 9,010,882 | B2 | 4/2015 | Romanov et al. |
| 9,038,233 | B2 | 5/2015 | Jones et al. |
| 9,078,552 | B2 | 7/2015 | Han et al. |
| 9,144,356 | B2 | 9/2015 | Yun |
| 9,167,946 | B2 | 10/2015 | Jones et al. |
| 9,211,045 | B2 | 12/2015 | Li et al. |
| 9,320,398 | B2 | 4/2016 | Hussey et al. |
| 9,320,400 | B2 | 4/2016 | Gilbert, Jr. et al. |
| 9,326,654 | B2 | 5/2016 | Doughty |
| 9,408,514 | B1 | 8/2016 | Alexander et al. |
| 9,414,734 | B2 | 8/2016 | Moon et al. |
| 9,480,374 | B2 | 11/2016 | Li et al. |
| 9,480,381 | B2 | 11/2016 | Schnittman et al. |
| 9,750,383 | B2 | 9/2017 | Janzen et al. |
| 9,839,335 | B2 | 12/2017 | Eriksson |
| 9,949,605 | B2 | 4/2018 | Isley et al. |
| 10,130,233 | B2 | 11/2018 | Jang et al. |
| 2003/0145424 | A1 | 8/2003 | Stephens et al. |
| 2004/0055106 | A1 | 3/2004 | Yacobi |
| 2006/0021168 | A1 | 2/2006 | Nishikawa |
| 2006/0037170 | A1 | 2/2006 | Shimizu |
| 2006/0042042 | A1 | 3/2006 | Mertes et al. |
| 2006/0293794 | A1 | 12/2006 | Harwig et al. |
| 2008/0052846 | A1 | 3/2008 | Kapoor et al. |
| 2008/0141485 | A1* | 6/2008 | Kim ..... A47L 9/009 15/347 |
| 2008/0281470 | A1 | 11/2008 | Gilbert, Jr. et al. |
| 2009/0000057 | A1 | 1/2009 | Yoo et al. |
| 2009/0229075 | A1 | 9/2009 | Eriksson |
| 2010/0205768 | A1 | 8/2010 | Oh |
| 2012/0181099 | A1 | 7/2012 | Moon et al. |
| 2012/0291809 | A1 | 11/2012 | Kuhe et al. |
| 2012/0311813 | A1 | 12/2012 | Gilbert, Jr. et al. |
| 2013/0152332 | A1* | 6/2013 | Jang ..... A47L 9/0488 15/319 |
| 2013/0204483 | A1 | 8/2013 | Sung et al. |
| 2013/0205520 | A1 | 8/2013 | Kapoor et al. |
| 2013/0211589 | A1 | 8/2013 | Landry et al. |
| 2014/0130294 | A1* | 5/2014 | Li ..... A47L 9/0488 15/372 |
| 2014/0156076 | A1 | 6/2014 | Jeong et al. |
| 2014/0188325 | A1 | 7/2014 | Johnson et al. |
| 2014/0317879 | A1 | 10/2014 | Blouin |
| 2015/0190028 | A1* | 7/2015 | Yan ..... A47L 11/16 15/49.1 |
| 2015/0359396 | A1 | 12/2015 | Yun |
| 2016/0058257 | A1 | 3/2016 | Ventress et al. |
| 2016/0073839 | A1 | 3/2016 | Janzen et al. |
| 2016/0075021 | A1 | 3/2016 | Cohen et al. |
| 2016/0113469 | A1 | 4/2016 | Schnittman et al. |
| 2016/0166127 | A1 | 6/2016 | Lewis |
| 2016/0213217 | A1 | 7/2016 | Doughty |
| 2016/0235270 | A1 | 8/2016 | Santini |
| 2016/0320778 | A1* | 11/2016 | Alexander ..... A47L 11/4036 |
| 2016/0345792 | A1 | 12/2016 | Herron et al. |
| 2017/0150859 | A1 | 6/2017 | Muir |
| 2017/0273531 | A1* | 9/2017 | Watanabe ..... A47L 9/0411 |
| 2018/0078106 | A1 | 3/2018 | Scholten et al. |
| 2018/0296049 | A1* | 10/2018 | Izawa ..... A47L 9/28 |

FOREIGN PATENT DOCUMENTS

| | | | | |
|---|---|---|---|---|
| DE | 102007060750 | A1 | 6/2009 | |
| DE | 102010000577 | | 8/2011 | |
| DE | 102010017211 | | 12/2011 | |
| DE | 102010017258 | | 12/2011 | |
| DE | 102012109970 | A1 * | 5/2014 | ..... A47L 9/02 |
| EP | 0424229 | | 4/1991 | |
| EP | 1994869 | | 11/2008 | |
| EP | 2543301 | | 1/2013 | |
| EP | 3409168 | A1 * | 12/2018 | ..... A47L 9/0488 |
| EP | 3440913 | A1 * | 2/2019 | ..... A47L 11/4066 |
| GB | 2529819 | | 3/2016 | |
| JP | 0542075 | | 2/1993 | |
| JP | 2000166826 | | 6/2000 | |
| JP | 2000353014 | A | 12/2000 | |
| JP | 2004222912 | | 8/2004 | |
| JP | 2010063624 | | 3/2010 | |
| JP | 2014087385 | | 5/2014 | |
| KR | 1020030083971 | | 11/2003 | |
| KR | 1020040013383 | | 2/2004 | |
| KR | 1020040051345 | | 6/2004 | |
| WO | 9210967 | | 7/1992 | |
| WO | 2005111084 | | 11/2005 | |
| WO | 2009117383 | | 9/2009 | |
| WO | 2014177216 | | 11/2014 | |
| WO | 2016034848 | | 3/2016 | |

OTHER PUBLICATIONS

US 8,359,703 B2, 01/2013, Svendsen et al. (withdrawn)

DE 102007060750 A1—English machine translation (Year: 2009).*

PCT Search Report and Written Opinion dated Nov. 14, 2018, received in corresponding PCT Application No. PCT/IB18/56190, 9 pgs.

(56) References Cited

OTHER PUBLICATIONS

PCT Search Report and Written Opinion dated Oct. 25, 2019, received in PCT Application No. PCT/US19/44717, 9 pgs.
PCT Search Report and Written Opinion dated Oct. 19, 2018, received in corresponding PCT Application No. PCT/US18/46218, 10 pgs.

* cited by examiner

ROBOTIC VACUUM

CROSS-REFERENCE TO RELATED APPLICATIONS

The present application claims the benefit of U.S. Provisional Application Ser. No. 62/546,520, filed on Aug. 16, 2017, entitled Robotic Vacuum with Antenna Brush, which is fully incorporated herein by reference.

TECHNICAL FIELD

This specification relates to surface cleaning apparatuses, and more particularly, to a robotic cleaning apparatus capable of cleaning beyond a periphery of the robotic cleaning apparatus.

BACKGROUND INFORMATION

The following is not an admission that anything discussed below is part of the prior art or part of the common general knowledge of a person skilled in the art.

A surface cleaning apparatus may be used to clean a variety of surfaces. Some surface cleaning apparatuses include a rotating agitator (e.g., brush roll). One example of a surface cleaning apparatus includes a vacuum cleaner which may include a rotating agitator as well as vacuum source. Non-limiting examples of vacuum cleaners include robotic vacuums, upright vacuum cleaners, canister vacuum cleaners, stick vacuum cleaners, and central vacuum systems. Another type of surface cleaning apparatus includes a powered broom which includes a rotating agitator (e.g., brush roll) that collects debris, but does not include a vacuum source.

Within the field of robotic and autonomous cleaning devices there are a range of form factors and features that have been developed to meet a range of cleaning needs. However, certain cleaning applications remain a challenge. For example, cleaning along running surface edges (e.g., floors, windows, walls) and within corners is important but impractical for devices primarily designed to clean horizontal surfaces, e.g., floors/rugs, and so on. Effectively cleaning such vertical/running surfaces while also being capable of reaching into corners raises numerous non-trivial design issues as well as navigational complexities to avoid robotic vacuums getting stuck/obstructed.

BRIEF DESCRIPTION OF THE DRAWINGS

These and other features advantages will be better understood by reading the following detailed description, taken together with the drawings wherein.

Figure 2:
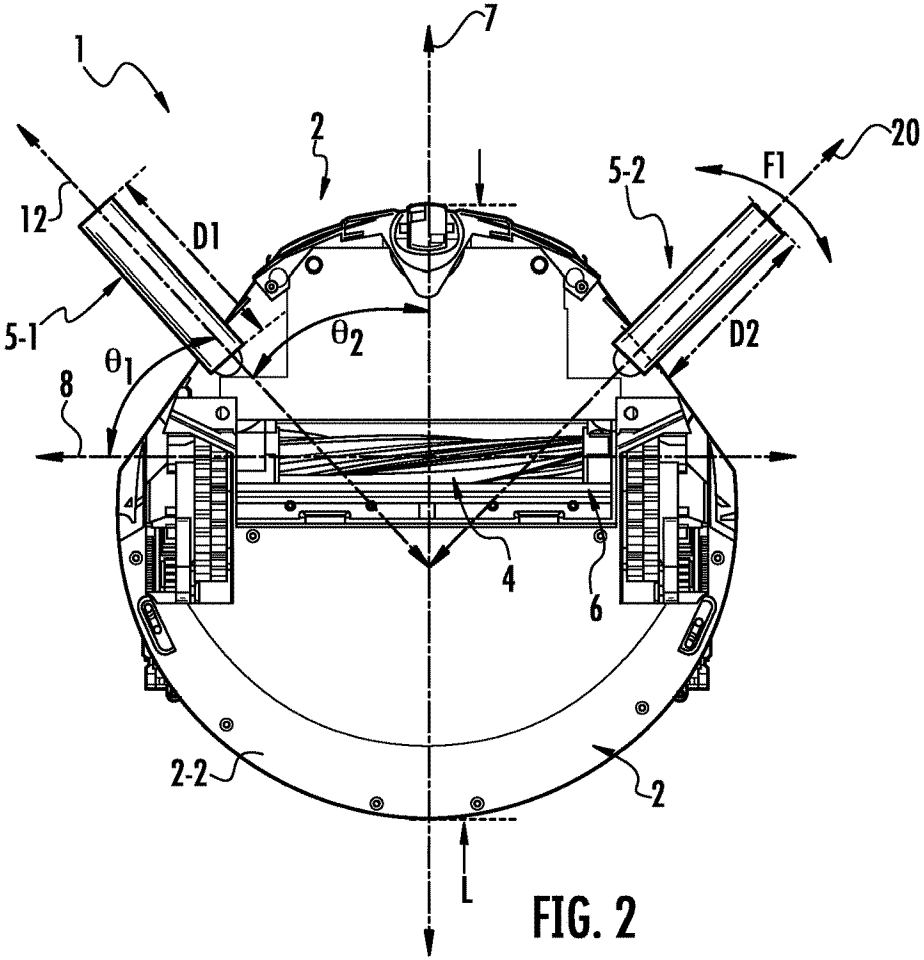
FIG. 2 is a bottom view of the surface cleaning apparatus of FIG. 1, consistent with the present disclosure.

The drawings included herewith are for illustrating various examples of articles, methods, and apparatuses of the teaching of the present specification and are not intended to limit the scope of what is taught in any way.

DETAILED DESCRIPTION

As discussed above, running surface edges and corners can be difficult areas to clean for robotic/autonomous vacuums. Some robotic vacuums have a relatively small form factor and are well suited for navigation (particularly in the case of random bounce), but may have a limited ability to effectively clean edges and corners based on a geometry of their respective housings and other constraints such as brush placement.

Thus, in accordance with an embodiment of the present disclosure, a robotic cleaning apparatus is disclosed that includes at least one brush assembly capable of cleaning edges and corners while eliminating or otherwise reducing the risk of getting "stuck" during cleaning operations. In accordance with another embodiment of the present disclosure there is provided a robotic cleaning apparatus having a D-shape and at least one antenna extending from a periphery of the robotic cleaning apparatus, wherein the antenna is configured to urge debris to a location under and/or that is in a moving path of the robotic cleaning apparatus.

Although the present disclosure specifically references floor-based robotic cleaning devices, this disclosure is not necessarily limited in this regard. Aspects and embodiments disclosed herein are equally applicable to wall and/or window cleaning robotic devices, wherein the robotic device travels vertically along the wall or target surface. In one specific example, a robotic cleaning device may be coupled to an inside surface of a skylight (or other window) and may utilize various details disclosed herein to clean edges and/or corners of the skylight.

As generally referred to herein, the term antenna may refer to an agitator having at least a portion that extends/projects from a body of a robotic vacuum in a manner that resembles antennae on an insect or to an agitator having at least one additional agitator coupled thereto, wherein at least a portion of the additional agitator extends/projects from a body of a robotic vacuum in a manner that resembles antennae on an insect. The term "antenna" is not intended to limit the brush assembly to a particular shape or configuration.

As generally referred to herein, the term resiliently deformable may refer to an ability of a mechanical component to repeatably transition between an un-deformed and a deformed state (e.g., transition between the un-deformed and deformed state at least 100 times, 1,000 times, 100,000 times, 1,000,000 times, or any other suitable number of times) without the component experiencing a mechanical failure (e.g., the component is no longer able to function as intended).

As generally referred to herein, the term surface to be cleaned generally refers to a surface on which a robotic cleaning apparatus travels, such as a floor. As may be appreciated, one or more side brushes and/or antennas may also clean a surface that extends transverse to the surface to be cleaned, such as a wall or obstacle.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
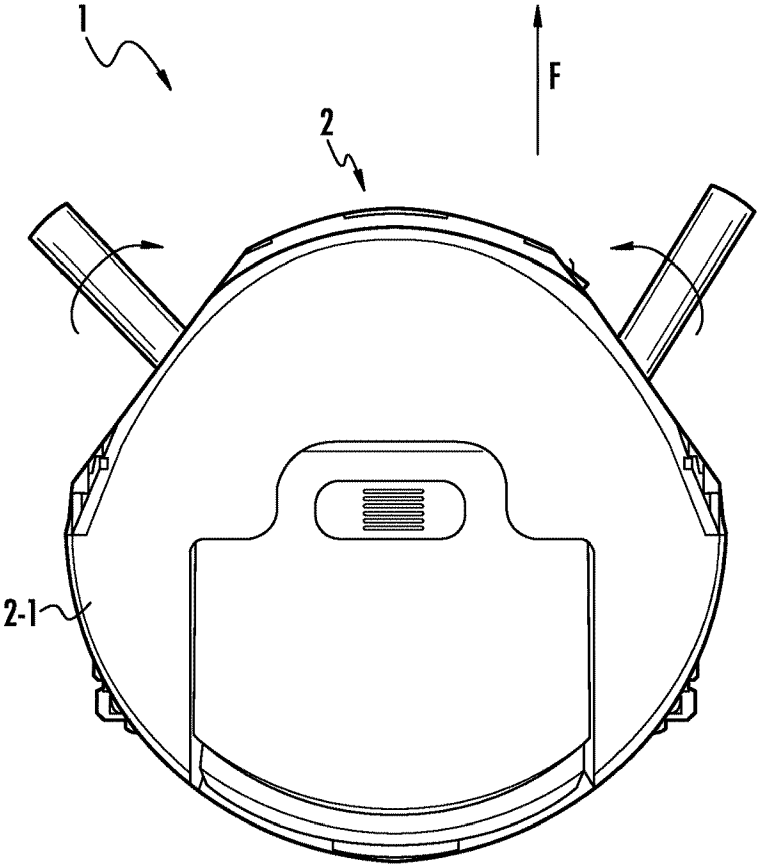
FIG. 1 is a top view of one embodiment of a surface cleaning apparatus, consistent with the present disclosure.

FIGS. 1 and 2 illustrate top and bottom perspective views, respectively, of one embodiment of a robotic cleaning apparatus 1. The robotic cleaning apparatus 1 may include a body 2 having at least a housing 2-1 and a chassis 2-2, one or more drive devices 3 (such as, but not limited to, one or more wheels and/or tracks driven by one or more electric motors and/or gears), and one or more primary cleaning devices 4 within an agitator chamber 6. The robotic cleaning apparatus may further include one or more extendable cleaning devices 5-1 and 5-2, which are discussed in further detail below. The extendable cleaning devices 5-1 and 5-2 may also be referred to as antenna cleaning devices, antenna brushes, brush assemblies, or simply brushes.

While not shown for clarity, the robotic cleaning apparatus 1 may also include one or more controllers, motors, sensors, and/or power sources (e.g., but not limited to, one or more batteries) disposed within and/or coupled to the body 2. As is well understood, the controllers, motors, sensors (and the like) may be used to navigate the robotic cleaning apparatus 1 such that the primary cleaning device 4 picks-up (e.g., sweeps up) and collects dust and debris (for example, optionally using suction airflow).

Figure 3:
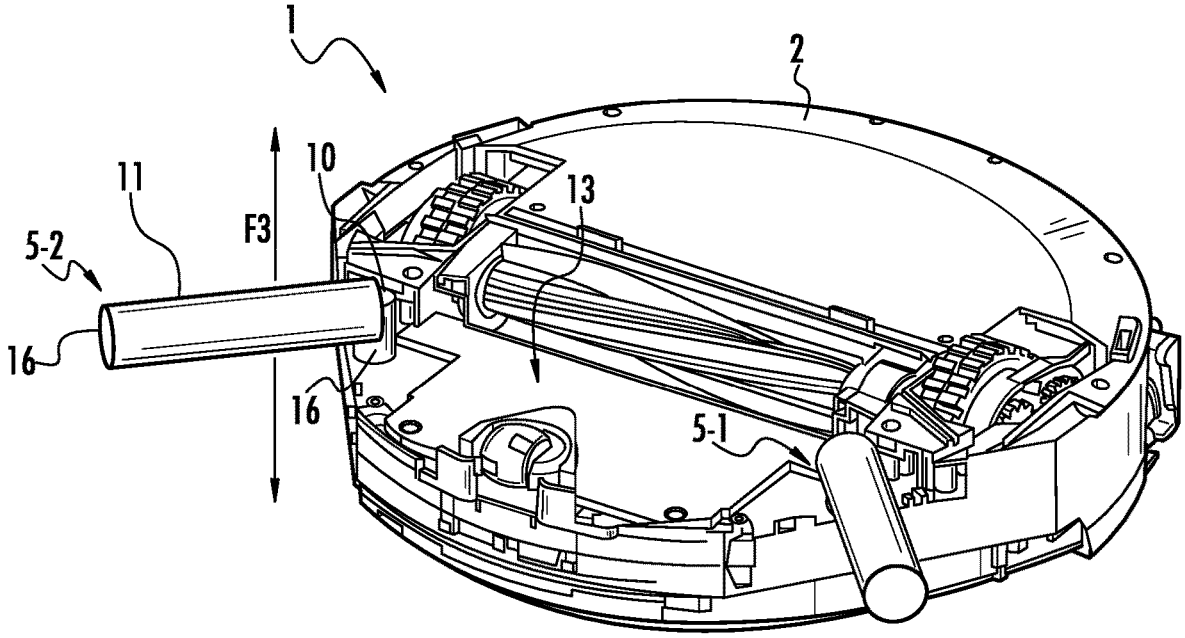
FIG. 3 is a bottom perspective view of the surface cleaning apparatus of FIG. 1, consistent with the present disclosure.
Figure 8:
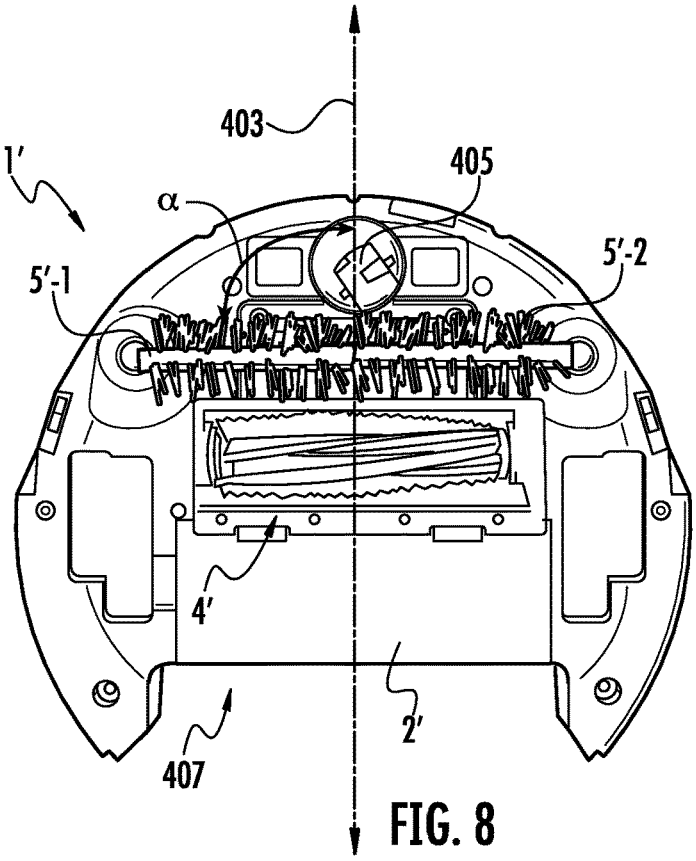
FIG. 8 is a bottom view of one embodiment of a surface cleaning apparatus, consistent with the present disclosure.
Figure 9:
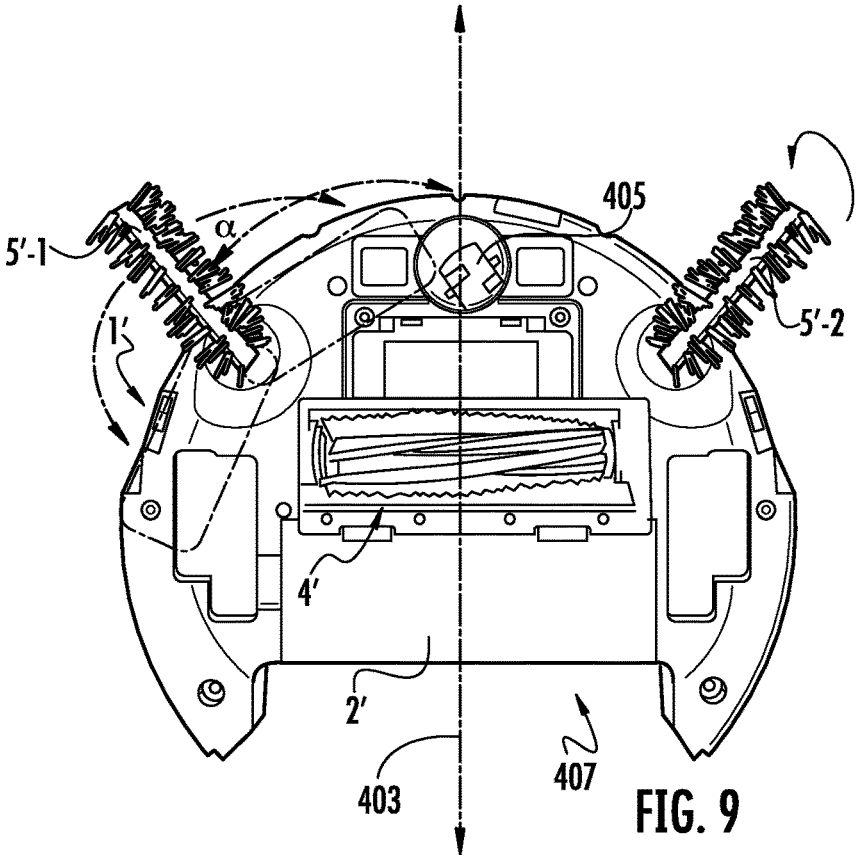
FIG. 9 is another bottom view of the surface cleaning apparatus of FIG. 8, consistent with the present disclosure.

Each of the antenna brushes 5-1 and 5-2 may include a first portion 10 to couple to the body 2 and a second portion 11, which is shown more clearly in FIG. 3. Thus, the first portion 10 may form a fulcrum about which the second portion 11 may rotate to make contact with the surface(s) to be cleaned. The second portion 11 may also be referred to as a brush portion. For example, FIGS. 8 and 9 show an example robotic cleaning apparatus 1' with antenna brushes having bristles. Other brush types are also within the scope of this disclosure. For instance, and without limitation, the antenna brushes may include a squeegee, a non-woven pad, or an abrasive media. Each antenna brush may have a continuous width, or may taper at an end. The antenna brushes may include replaceable elements, e.g., replaceable bristles. This may allow for different bristle types to be easily installed to target varying surface types, e.g., hardwood floors, carpet, etc.

Figure 4:
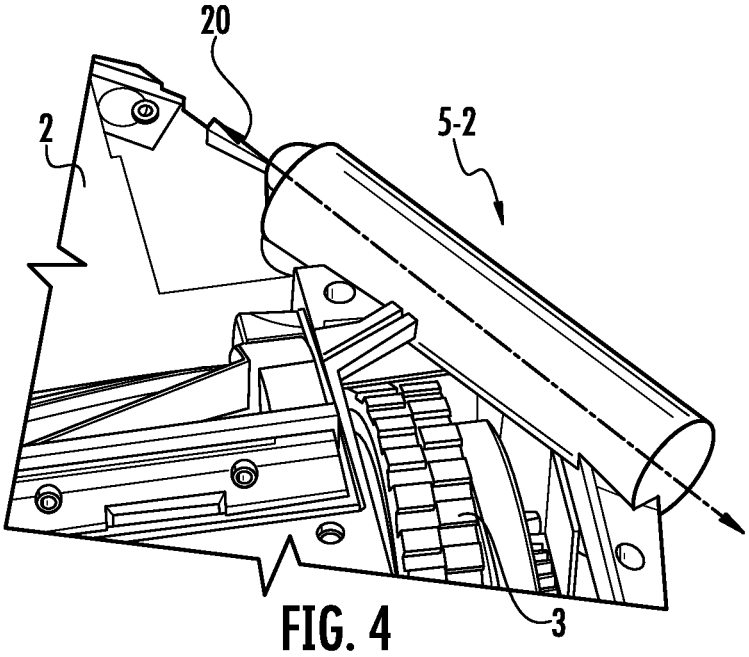
FIG. 4 is an enlarged view of a portion of the surface cleaning apparatus of FIG. 3, consistent with the present disclosure.
Figure 7:
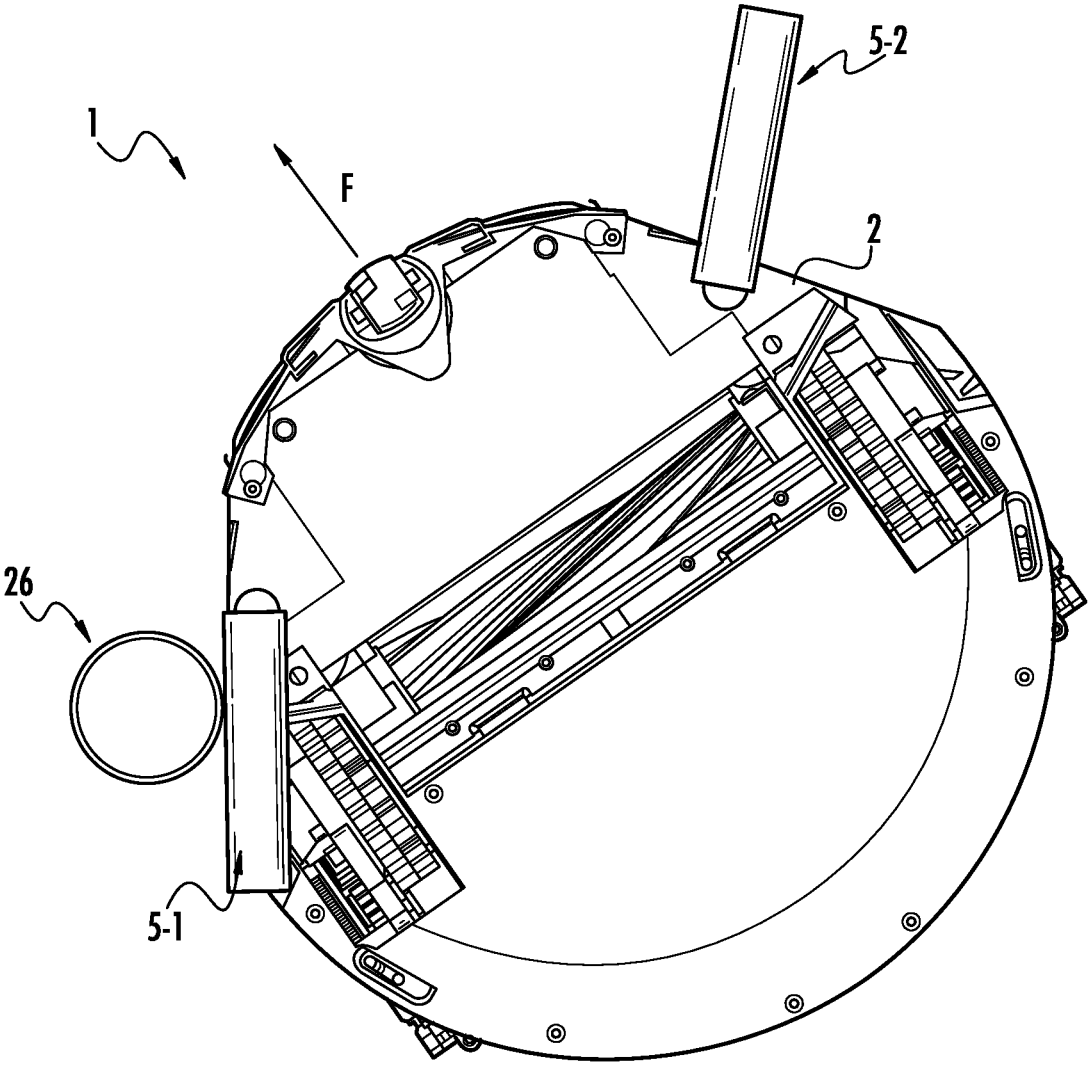
FIG. 7 is another bottom view of the surface cleaning apparatus of FIG. 1, consistent with the present disclosure.

In an embodiment, each of the antenna brushes 5-1 and 5-2 extend from the body 2 at a predetermined angle relative to the body 2. As shown, the body 2 includes a longitudinal axis 7. Note that body 2 may not necessarily include a longitudinal axis (e.g., the body 2 may have a circular shape). The agitator chamber 6 may also define a longitudinal axis 8. Thus, the antenna brush 5-1 includes a longitudinal axis 12 that extends from the body 2 at an angle of $\theta_2$ relative to the longitudinal axis 7 of the body 2, with angle $\theta_2$ being about 45 degrees although other angles are within the scope of this disclosure. For example, angle $\theta_2$ may include a range of angles between 30 and 60 degrees. However, each of the antenna brushes 5-1 and 5-2 may have a relatively wide range of angles and may extend beyond 30 to 60 degrees, e.g., as shown in FIGS. 4 and 7, and the provided examples should not be construed as limiting.

Likewise, the longitudinal axis 12 of the antenna brush 5-1 may also extend at an angle $\theta_1$ relative to the longitudinal axis 8 of the agitator chamber 6, with angle $\theta_2$ also being about 45 degrees. However, each of the angles $\theta_1$ and $\theta_2$ may not necessarily be equal depending on the configuration of the robotic cleaning apparatus 1.

Figure 5:
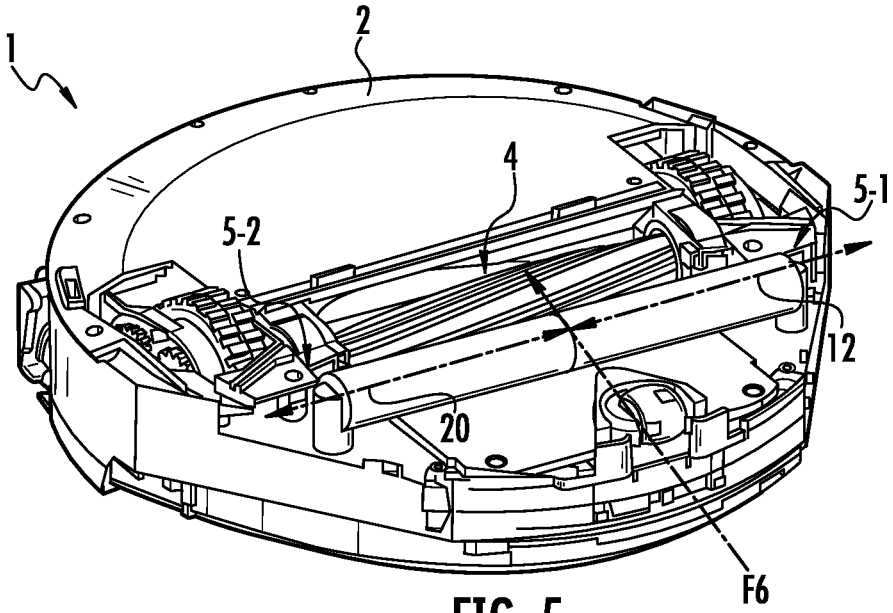
FIG. 5 is a perspective view of the surface cleaning apparatus of FIG. 1, consistent with the present disclosure.
Figure 6:
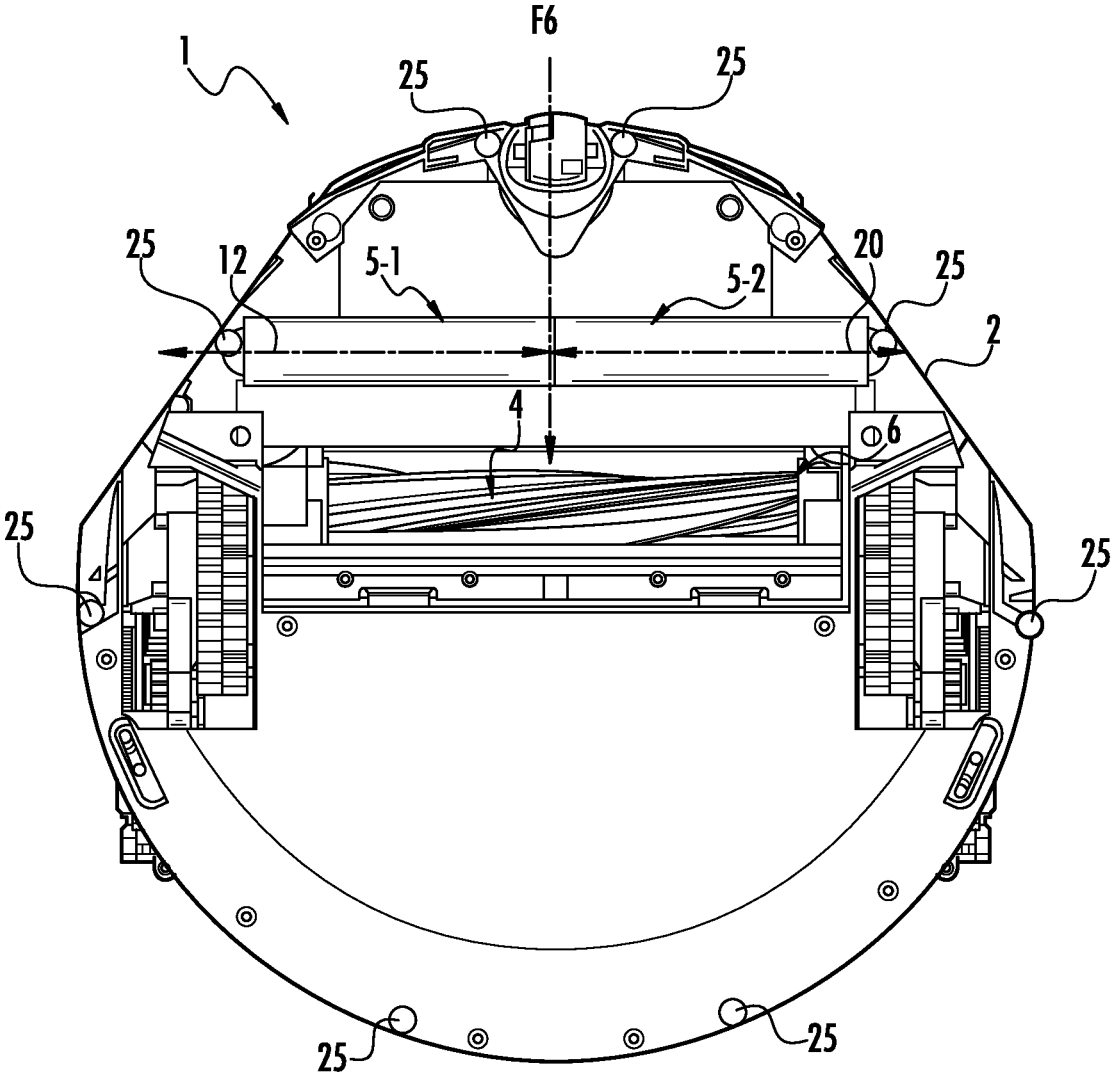
FIG. 6 is a bottom view of the surface cleaning apparatus of FIG. 1, consistent with the present disclosure.

Each of the antenna brushes 5-1 and 5-2 may be fixed at a particular angle, e.g., at angles $\theta_1$ and $\theta_2$, respectively. For example, each of the antenna brushes may generally resist movement along direction F1 and may "flex" or bend to some degree before returning to their respective fixed positions. In other cases, each of antenna brushes 5-1 and 5-2 may be rotatably coupled to the body 2 and may allow for rotational movement along path F1. For example, each of the antenna brushes 5-1 and 5-2 may have a retracted position, such as shown in FIGS. 5 and 6, and an extended position, such as shown in FIGS. 1 and 2. Thus, the antenna brushes 5-1 and 5-2 may transition/move between a plurality of intermediate positions based on rotational movement.

The antenna brushes 5-1 and 5-2 may be configured to "lock" at one or more of the retracted positions, intermediate positions, and/or an extended position to target a particular edge or corner surface, for instance. The antenna brushes 5-1 and 5-2 may be configured to move automatically based on gears or other suitable mechanisms, or may be moved manually through a user-applied force.

In any event, each of the antenna brushes 5-1 and 5-2 may be configured to rotate about the body 2 in a manner independent of each other. In other cases, each of the antenna brushes 5-1 and 5-2 may be configured to mechanically move together, which is to say rotational movement of one results in a proportional movement of the other.

Continuing with FIGS. 1 and 2, each of the antenna brushes 5-1 and 5-2 may be configured to rotate about an axis that is substantially parallel with a surface to be cleaned to direct dust and debris during cleaning. For example, antenna brush 5-1 may have a rotational axis that generally follows its longitudinal axis 12. The direction of rotation for antenna brush 5-1 may generally direct dust and debris towards the body 2. Thus, dirt and debris may be swept towards the agitator chamber 6 or at least in the path of the robotic vacuum apparatus 1 as the same travels along movement direction F. In this example, antenna brush 5-1 may rotate clockwise.

Likewise, the antenna brush 5-2 may also have an axis of rotation which is substantially parallel with the surface to be cleaned to sweep/direct dirt and debris towards the agitator chamber 6. However, the antenna brush 5-2 may rotate in a direction opposite of that of the antenna brush 5-1, e.g., counter clockwise, to ensure that dirt and debris is properly directed into the path of the robotic cleaning apparatus 1. In a general sense, the cleaning element/bristles of each of the brushes 5-2 and 5-3 may allow for corkscrew-like movement to direct dirt from edge/corner surface(s) towards a suction chamber, e.g., the agitator chamber 6.

Each of the antenna brushes 5-1 and 5-2 may extend a distance D1 and D2, respectively, away from the body 2 when in the extended position. The distance D1 and D2 may be equal, or may be different. The distance D1 and/or D2 relative to the overall length L of the body 2 may be a predefined ratio. For instance, if the ratio of D1/D2 to L may be 1:3, 1:4, 1:6, although other ratios are within the scope of this disclosure.

The second portion 11 of each antenna brush 5-1 and 5-2 may be flexible, e.g., may be configured to bend at least 90 degrees back towards the first portion 10, and preferably, 180 degrees back towards the first portion 10.

Thus, the antenna brushes 5-1 and 5-2 may include a first axis of rotation that allows movement relative to the body 2 to target edge and/or corner surface(s). The antenna brushes 5-1 and 5-2 may also have a second axis of rotation, which may extend substantially in parallel with a surface to be cleaned, to allow each brush portion to "spin" and direct dust/debris towards the primary cleaning device 4.

Turning to FIG. 3, another perspective view of the robotic cleaning apparatus 1 is shown in accordance with an embodiment of the present disclosure. As shown, the body 2 may include a recessed region 13 to at least partially receive each of antenna brushes 5-1 and 5-2. The recessed region 13 may, therefore, allow the antenna brushes 5-1 and 5-2 to retract inwardly to a retracted position without obstructing movement of the robotic cleaning apparatus 1.

In an embodiment, sensory may be disposed at one or more locations along each of the antenna brushes 5-1 and 5-2. For example, a sensor 16 may be disposed at a distal end of the antenna brush 5-1 and/or at an end proximal to the body 2. The sensor 16 may be a proximity sensor or other sensor that provides environmental and/or physical information that may be utilized to make navigational decisions.

FIG. 4 shows an enlarged view of a portion of the body 2 of the robotic cleaning apparatus 1. As shown, the antenna brush 5-2 may be rotated to a position that causes the longitudinal axis 20 of the same to be transverse to the longitudinal axis 7 of the body 2 (see FIG. 2). This may advantageously allow the antenna brush 5-2 to rest relatively flush against sidewalls of the body 2 to prevent the antenna brush 5-2 from catching on objects/walls in the environment, e.g., see FIG. 7, as the robotic cleaning apparatus 1 moves. For example, and as shown in FIG. 4, the antenna brush 5-2 can extend along a portion of the body 2 that extends between the drive device 3 and the environment.

In an embodiment, each of the antenna brushes 5-1 and 5-2 may be configured to move up and down along path F3 (see FIG. 3) to allow for each brush to adjust to various types of floors, e.g., hardwood, carpet, and so on.

FIGS. 5 and 6 show additional perspective views of the robotic cleaning apparatus 1 in accordance with an embodiment of the present disclosure. As shown, the robotic cleaning apparatus 1 may include a retracted position for the antenna brushes 5-1 and 5-2, whereby the antenna brushes 5-1 and 5-2 form, essentially, a single brush. In particular, the retracted position may include the longitudinal axis 12 and longitudinal axis 20 of the antenna brushes 5-1 and 5-2, respectively, being substantially in parallel and/or collinear.

Thus, the antenna brushes 5-1 and 5-2 may form an integrated cleaning device with the primary cleaning device 4 to increase air flow along direction F6, dislodge dust and debris, and guide the same into a dust cup within the body 2. Additional details of the primary cleaning device 4 working in combination with a secondary brush, e.g., the antenna brushes 5-1 and 5-2 in the retracted position, is discussed in greater detail in Application Ser. No. 62/469,853 filed Mar. 10, 2017, and application Ser. No. 15/492,320 filed Apr. 20, 2017, and each are fully incorporated herein by reference.

In an embodiment, the body 2 may further include a plurality of drop sensors 25 disposed around a perimeter of the same to detect, for example, stairs and ledges.

FIG. 7 shows another example perspective view of the robotic cleaning apparatus 1 in accordance with an embodiment of the present disclosure. As shown, each antenna brush 5-1 and 5-2 may rotate and/or bend to ensure the robotic cleaning apparatus 1 moves around obstructions. For example, the antenna brush 5-1 may fold/rotate and rest flush against a sidewall of the body 2 in response to contacting an obstruction 26, to allow the robotic cleaning apparatus to continue along direction F without getting stuck or otherwise obstructed.

FIGS. 8 and 9 show an example of a robotic cleaning apparatus 1', which may be an example of the robotic cleaning apparatus 1 that includes a body 2' having a generally circular shape. As shown, the robotic cleaning apparatus 1' includes antenna brushes 5'-1 and 5'-2 configured to rotate between an extended position (e.g., as shown in FIG. 9), a brush roll position (e.g., as shown in FIG. 8), and a walling cleaning position (e.g., the antenna brushes 5'-1 and 5'-2 extend along a side of the body 2'). In other words, the antenna brushes 5'-1 and 5'-2 can be generally described as being configured to rotate at least 180° about a rotation axis that extends generally perpendicular to a bottom surface (e.g., the surface facing a surface to be cleaned when the robotic cleaning apparatus 1' is in operation) of the body 2'.

The antenna brushes 5'-1 and 5'-2 can form an angle α with an axis 403 of the body 2' that extends through a caster wheel 405 and a receptacle 407 for receiving a dust cup. In other words, the axis 403 extends generally parallel to a forward direction of movement of the robotic cleaning apparatus 1'. For example, when the antenna brushes 5'-1 and 5'-2 are in the retracted position, the angle α may measure approximately 90° (e.g., in a range of 85° to 95°). By way of further example, when the antenna brushes 5'-1 and 5'-2 are in the extended position, angle α may measure approximately 45° (e.g., in a range of 40° to 50°). By way of still further example, when the antenna brushes 5'-1 and 5'-2 are in the wall cleaning position, angle α may measure approximately 135° (e.g., in a range of 130° to 140°).

When the antenna brushes 5'-1 and 5'-2 are in the extended position at least a portion of the antenna brushes 5'-1 and 5'-2 can be configured to engage an edge of an obstacle or a corner. When the antenna brushes 5'-1 and 5'-2 are in the retracted position, the antenna brushes 5'-1 and 5'-2 are configured such that the antenna brushes 5'-1 and 5'-2 do not substantially obstruct forward movement of the robotic cleaning apparatus 1'. Regardless of orientation, the antenna brushes 5'-1 and 5'-2 are configured to rotate such that debris are urged in a direction of a movement path of the robotic cleaning apparatus 1'.

Figure 10:
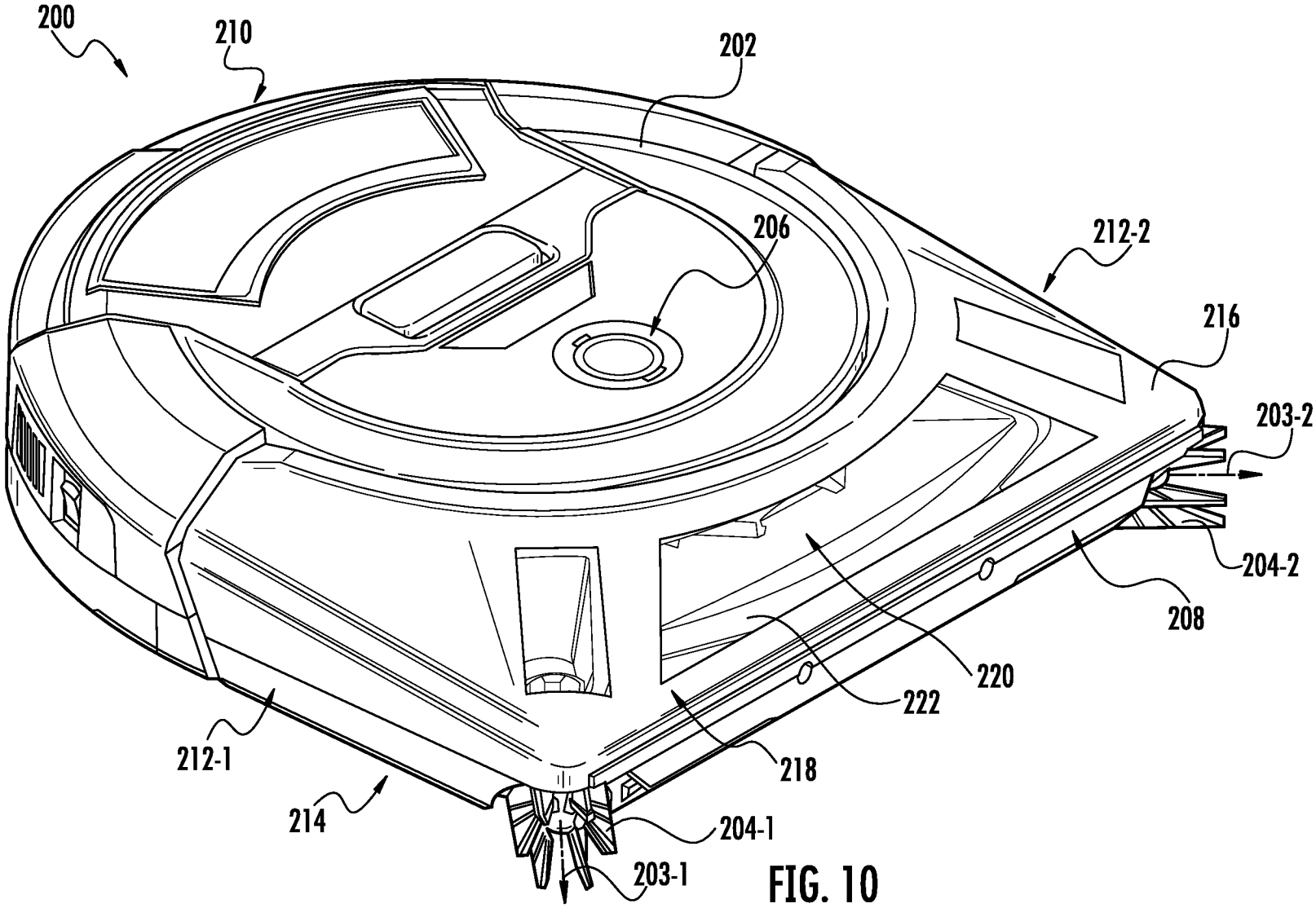
FIG. 10 is a perspective view of one embodiment of a surface cleaning apparatus, consistent with the present disclosure.

FIG. 10 shows a perspective view of a robotic cleaning apparatus 200 having a body 202, a plurality of antennas 204-1 and 204-2, and a user interface 206. As shown, the body 202 includes a substantially planar forward surface 208 and an arcuate rearward surface 210. The body 202 can also include, a plurality of side surfaces 212-1 and 212-2 extending between the forward surface 208 and the rearward surface 210. The side surfaces 212-1 and 212-2 can be substantially planar. As such, the body 202 can be generally described as defining a D-shape.

At least a portion of the antennas 204-1 and 204-2 can extend from the forward surface 208 of the body 202 such that the antennas 204-1 and 204-2 urge debris from beyond a periphery of the body 202 towards an underside 214 of the body 202 and/or in a direction of a movement path of the robotic cleaning apparatus 200. In other words, the antennas 204-1 and 204-2 are configured to rotate about a respective rotation axis 203-1 and 203-2 that extends generally parallel to a surface to be cleaned. For example, the antennas 204-1 and 204-2 can extend from the body 202 such that the antennas 204-1 and 204-2 are positioned between the forward surface 208 and a respective one of the side surfaces 212-1 and 212-2. In other words, a portion of each of the antennas 204-1 and 204-2 extends from the forward surface 208 and a portion of each of the antennas 204-1 and 204-2 extends from a respective one of the side surfaces 212-1 and 212-2.

The body 202 can include a displaceable bumper 216 that is slideably coupled thereto. As shown, the displaceable bumper 216 defines at least a portion of the forward surface 208. The displaceable bumper 216 can be displaced, relative to a portion of the body 202, in response to the displaceable bumper 216 engaging (e.g., contacting) an obstacle. The displaceable bumper 216 can be configured to actuate one or more switches (e.g., mechanical, optical, and/or any other switch) when the displaceable bumper 216 is displaced in response to engaging an obstacle.

As shown, the displaceable bumper 216 can define an opening 218 such that an optical navigation system 220 can be disposed behind the displaceable bumper 216. The optical navigation system 220 can generate data capable of being used to generate one or more maps of an environment and/or to detect obstacles within an environment. A window 222 can be disposed within the opening 218 and be configured such that the window 222 does not substantially interfere with the optical navigation system 220. For example, the window 222 can be configured to be transparent to at least those wavelengths of light used by the optical navigation system 220. The optical navigation system 220 can include, for example, one or more cameras (e.g., a stereo camera), one or more laser range finders, and/or any other system for optical navigation. In some instances, the optical navigation system 220 can include a light emission system configured to emit structured light into an environment. Additionally, or alternatively, the robotic cleaning apparatus 200 can include one or more acoustic navigation components (e.g., sound emitters and detectors) for navigation.

Figure 11:
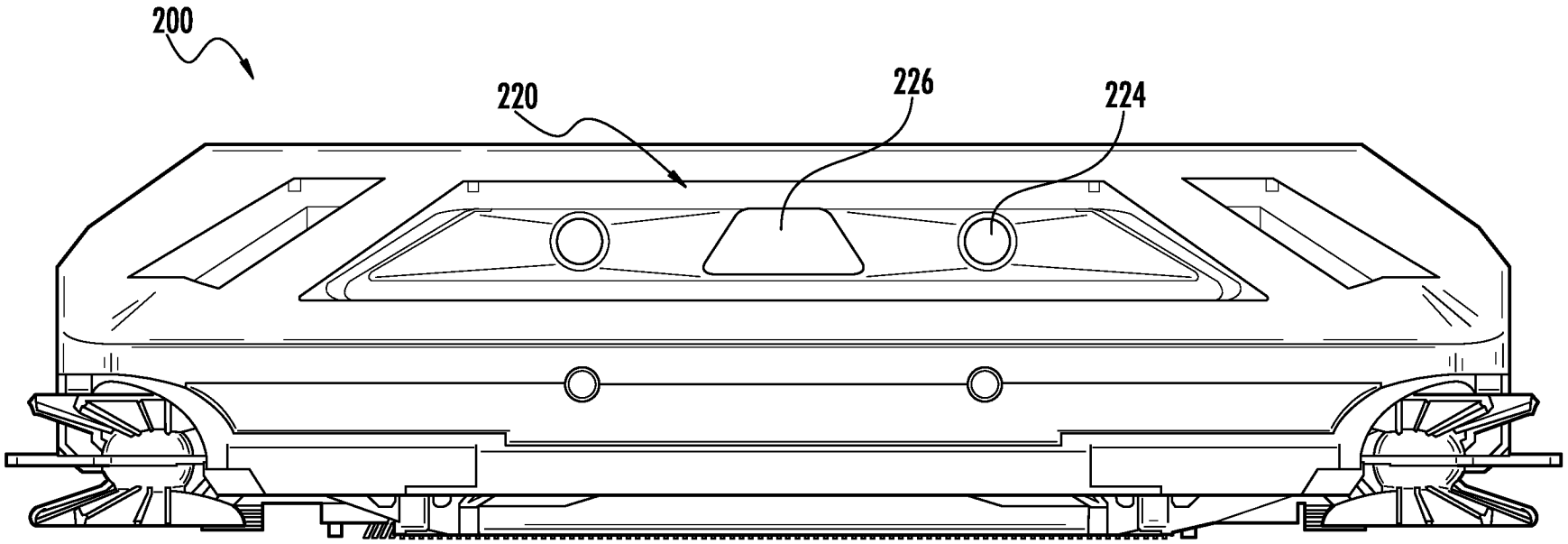
FIG. 11 is a front view of the surface cleaning apparatus of FIG. 10, consistent with the present disclosure.

FIG. 11 is a front view the robotic cleaning apparatus 200. As shown, the optical navigation system 220 includes a stereo camera 224 and a structured light emitter 226. The structured light emitter 226 can be configured to emit light (e.g., infrared light) into the environment of the robotic cleaning apparatus 200. The structured light can be, for example, a random dot pattern projected in front of the robotic cleaning apparatus 200.

While the robotic cleaning apparatus 200 is shown as including an optical navigation system, other systems are contemplated and within the scope of the present disclosure. For example, the robotic cleaning apparatus 200 can utilize a random bounce navigation algorithm (e.g., the robotic cleaning apparatus 200 detects obstacles in response to contacting the obstacle). In some instances, a random bounce robotic cleaning apparatus 200 can include one or more optical navigation components (e.g., infrared emitters and detectors) and/or acoustic navigation components (e.g., sound emitters and detectors) configured to detect the presence of obstacles without the generation of an image and/or map. As such, the random bounce robotic cleaning apparatus 200 can be configured to detect obstacles without contacting the obstacle.

Figure 12:
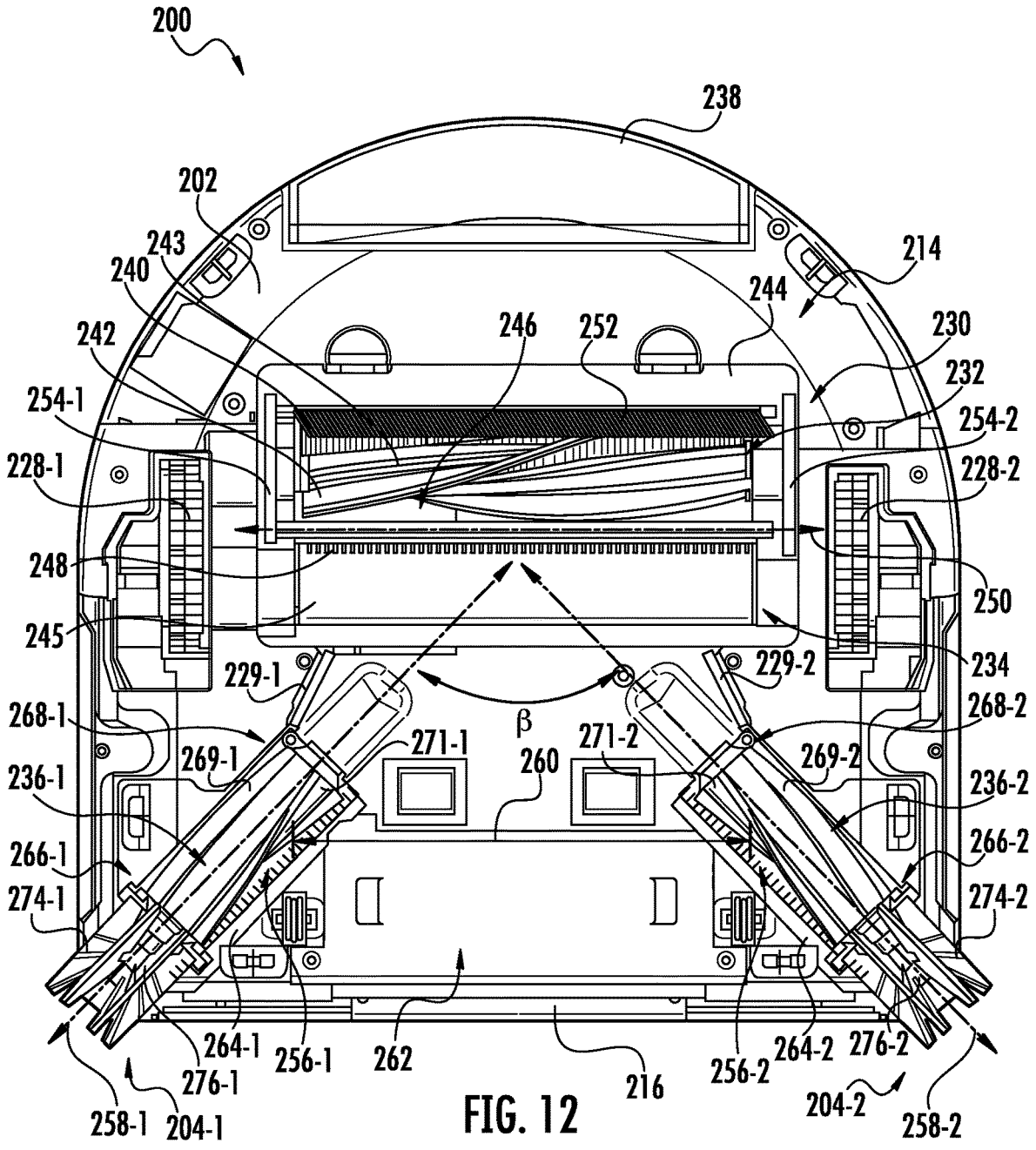
FIG. 12 is a bottom view of the surface cleaning apparatus of FIG. 10, consistent with the present disclosure.

FIG. 12 shows a bottom view of the robotic cleaning apparatus 200. As shown, the robotic cleaning apparatus 200 includes a plurality of driven wheels 228-1 and 228-2, an agitator assembly 230 having a first assembly agitator (e.g., a brush roll) 232 and a second assembly agitator (e.g., a brush roll) 234 arranged in parallel, and a plurality of antenna agitators (e.g., brush rolls) 236-1 and 236-2 coupled to a respective one of the antennas 204-1 and 204-2. The agitator assembly 230 is fluidly coupled to a dust cup 238 and suction motor (not shown) such that a suction force can cause debris to be urged from a surface to be cleaned into the dust cup 238. The first and second agitators 232 and 234 are configured to engage the surface to be cleaned such that debris on the surface to be cleaned is disturbed and/or urged into the dust cup 238.

The first agitator 232 can be different from the second agitator 234. For example, the first agitator 232 can include one or more strips of bristles 240 and/or resiliently deformable flaps 242 extending along an exterior surface of a body 243 of the first agitator 232 and the second agitator 234 can include a plurality of fibers extending from an exterior surface of a body 245 of the second agitator 234 such that the exterior surface is substantially covered in the fibers. The fibers covering the second agitator 234 can be more flexible (e.g., softer) than the bristles 240 and/or deformable flaps 242 extending around the first agitator 232. As such, the second agitator 234 may generally be described as a soft brush and the first agitator 232 may generally be described as a brush roll.

While the agitator assembly 230 is shown as having a plurality of agitators, other configurations are contemplated and within the scope of the present disclosure. For example, the agitator assembly 230 may include only one agitator. By way of further example, the agitator assembly 230 may include at least three agitators. Further, while the agitator assembly 230 is shown as being centrally disposed between the driven wheels 228-1 and 228-2 and closer to the dust cup 238 than the displaceable bumper 216, other configurations are contemplated and within the scope of the present disclosure. For example, the agitator assembly 230 may be disposed closer to one of the driven wheels 228-1 or 228-2 than the other of the driven wheels 228-1 or 228-2. By way of further example, the agitator assembly 230 may be disposed rearward or forward of the driven wheels 228-1 and 228-2. In other words, the number of agitators and the location of the agitator assembly 230 is shown for purposes of illustration only and other configurations are contemplated and within the scope of the present disclosure.

As shown, an agitator cover 244 extends around a chamber 246 for receiving the first and second agitators 232 and 234. The agitator cover 244 can be configured to be removable such that the first and second agitators 232 and 234 can be removed from the chamber 246 (e.g., for replacement and/or cleaning). The agitator cover 244 can also include a plurality of teeth 248 extending along a longitudinal axis 250 of the agitator assembly 230 and disposed between the first and second agitators 232 and 234 such that the plurality of teeth 248 are configured to engage the second agitator 234. The plurality of teeth 248 are configured to remove fibrous debris, such as hair, that has wrapped around the second agitator 234 from the second agitator 234. Additionally, or alternatively, a second plurality of teeth can be provided that are configured to engage the first agitator 232.

As also shown, the agitator cover 244 includes a first flexible strip 252 (e.g., a bristle strip, a resiliently deformable flap, or any other flexible strip). The first flexible strip 252 extends substantially parallel to the longitudinal axis 250 at a location adjacent the first agitator 232. The first flexible strip 252 is configured to engage a surface to be cleaned and urge debris on the surface to be cleaned in a direction of the first and second agitators 232 and 234. The agitator cover 244 can also include a plurality of second flexible strips 254-1 and 254-2 extending transverse (e.g., substantially perpendicular) to the longitudinal axis 250. As shown, the plurality of second flexible strips 254-1 and 254-2 are disposed on opposing sides of the agitator cover 244 at location between the driven wheels 228-1 and 228-2. The second plurality of flexible strips 254-1 and 254-2 are configured to urge debris in a direction of the first and second agitators 232 and 234. The second flexible strips 254-1 and 254-2 may include bristles, a resiliently deformable material (e.g., a natural or synthetic rubber), and/or any other flexible material.

Each of the antenna agitators 236-1 and 236-2 are configured to extend along a respective channel 256-1 and 256-2 and engage a surface to be cleaned. The antenna agitators 236-1 and 236-2 are arranged such that a longitudinal axis (and/or rotational axis) 258-1 of the first antenna agitator 236-1 extends transverse to a longitudinal axis (and/or rotational axis) 258-2 of the second antenna agitator 236-2, wherein the longitudinal axes 258-1 and 258-2 extend generally parallel to a surface to be cleaned. For example, the antenna agitators 236-1 and 236-2 can be arranged such that a separation distance 260 between the antenna agitators 236-1 and 236-2 decreases as the antenna agitators 236-1 and 236-2 approach the agitator assembly 230. In other words, the antenna agitators 236-1 and 236-2 may generally be described as defining a V-shaped debris channel 262 that extends from a forward portion of the body 202 towards the agitator assembly 230.

An angle β defined between the longitudinal axes 258-1 and 258-2 can measure, for example, in a range of 45° to 135°. By way of further example, the angle β can measure in a range of 60° to 120°. By way of still further example, the angle β can measure in a range of 75° to 105°. By way of further example, the angle β can measure 90°.

Each of the antenna agitators 236-1 and 236-2 are configured to rotate in a direction that urges debris towards the debris channel 262 defined between the antenna agitators 236-1 and 236-2. As such, the antenna agitators 236-1 and 236-2 can generally be described as counter rotating (e.g., the first antenna agitator 236-1 can be configured to rotate in a first direction and the second antenna agitator 236-2 can be configured to rotate in a second direction, the first direction being opposite the second). A plurality of third flexible strips 229-1 and 229-2 can extend between a respective antenna agitator 236-1 and 236-2 and the agitator assembly 230. The third flexible strips 229-1 and 229-2 can be configured to urge debris in a direction of the debris channel 262. The third flexible strips 229-1 and 229-2 may include bristles, a resiliently deformable material (e.g., a natural or synthetic rubber), and/or any other flexible material.

The antenna agitators 236-1 and 236-2 each include a plurality resiliently deformable flaps 269-1 and 269-2 extending along an exterior surface of a body 271-1 and 271-2 of the antenna agitators 236-1 and 236-2. Additionally, or alternatively, the antenna agitators 236-1 and 236-1 can include one or more strips of bristles extending along the exterior surface of the body 271-1 and 271-2. In some instances, the plurality of deformable flaps 269-1 and 269-2 can be configured to urge fibrous debris, such as hair, towards a common point along the antenna agitators 236-1 and 236-2. For example, the plurality of deformable flaps 269-1 and 269-2 can be configured to urge fibrous debris, such as hair, to a location where it is easily removable by a user and/or in a direction of a cutter or grinder.

As shown, a plurality of teeth 264-1 and 264-2 extend along each of the channels 256-1 and 256-2. The plurality of teeth 264-1 and 264-2 are configured to engage a respective one of the antenna agitators 236-1 and 236-2 (e.g., the resiliently deformable flaps 269-1 and 269-2). The plurality of teeth 264-1 and 264-2 may remove fibrous debris, such as hair, that has become wrapped around the antenna agitators 236-1 and 236-2. Additionally, or alternatively, a cutter or grinder may be disposed proximate a first and/or second distal end 266-1 and 266-2 and 268-1 and 268-2 of a respective antenna agitator 236-1 and 236-2 (e.g., in an end region having a length measuring 5%, 10%, 25%, or 35% of an overall length of the antenna agitators 236-1 and 236-2). In these instances, the antenna agitators 236-1 and 236-2 can be configured such that fibrous debris, such as hair, is urged towards the cutter or grinder. As such, fibrous debris, such as hair, can be broken in to smaller pieces that are more easily suctioned into the dust cup 238 without becoming entangled on one or more of the antenna agitators 236-1 and 236-2 and/or the first and second agitators 232 and 234.

Figure 13:
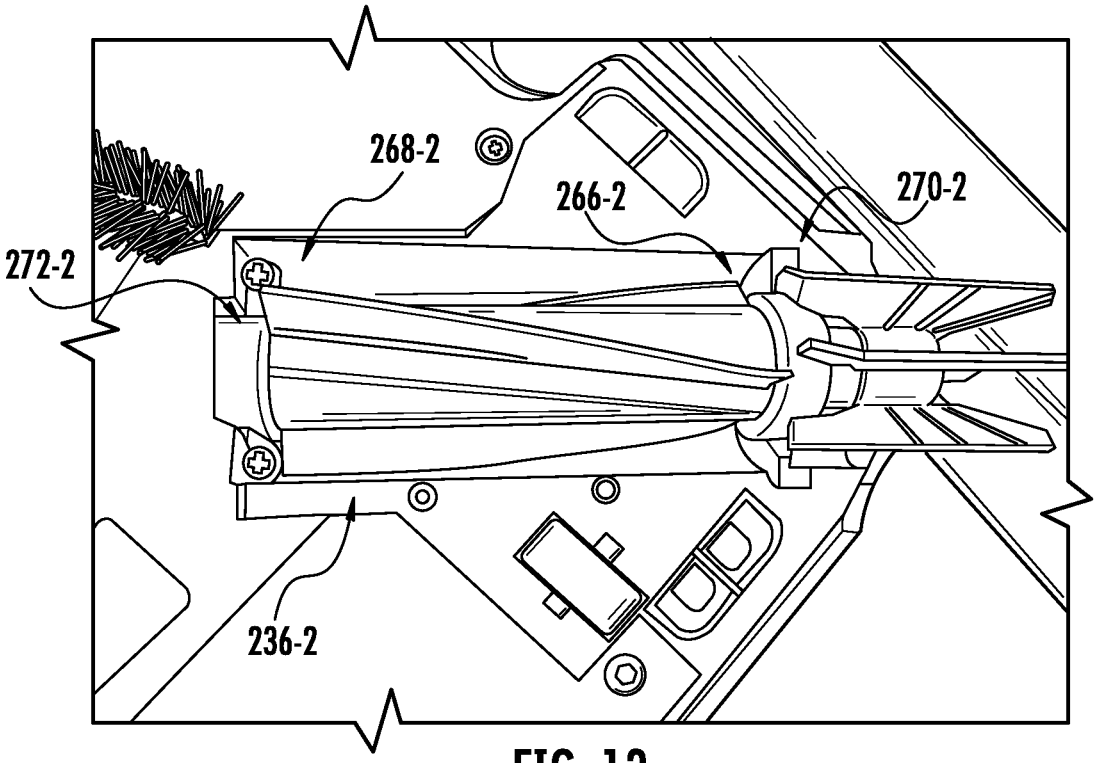
FIG. 13 is a perspective view of an antenna assembly capable of being used with the surface cleaning apparatus of FIG. 10, consistent with the present disclosure.
Figure 14:
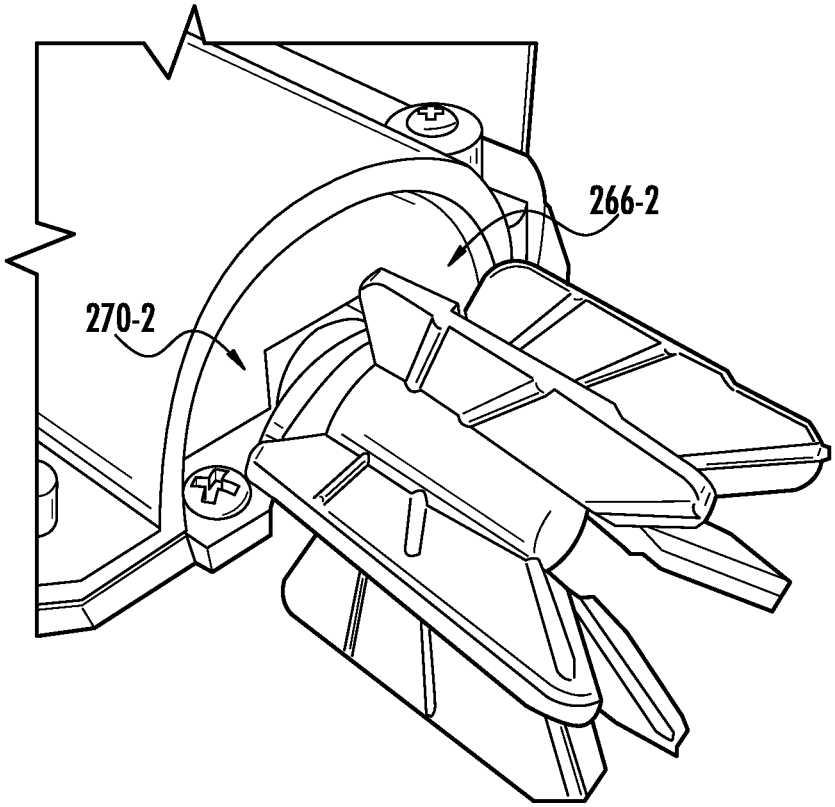
FIG. 14 is a perspective view of an example of the antenna assembly of FIG. 13, consistent with the present disclosure.

For example, FIGS. 13 and 14 show an example of a first blade 270-2 disposed proximate the first distal end 266-2 and a second blade 272-2 disposed proximate the second distal end 268-2 of the antenna agitator 236-2 (e.g., in an end region having a length measuring 5%, 10%, 25%, or 35% of an overall length of the antenna agitators 236-1 and 236-2). As shown, as fibrous debris, such as hair, wraps around the antenna agitator 236-2, the fibrous debris migrates towards one of the first or the second blade 270-2 and 272-2. When the fibrous debris reaches one of the first or second blades 270-2 and 272-2, the fibrous debris is ground and/or cut into smaller segments.

Referring again to FIG. 12, each of the antennas 204-1 and 204-2 extend from a respective one of the first distal ends 266-1 and 266-2 of the antenna agitators 236-1 and 236-2. Each of the antennas 204-1 and 204-2 are configured to rotate with the antenna agitators 236-1 and 236-2. As such, the antennas 204-1 and 204-2 urge debris from beyond a perimeter of the body 202 towards the underside 214 of the body 202 and/or into a movement path of the robotic cleaning apparatus 200 (e.g., into the debris channel 262 defined between the antenna agitators 236-1 and 236-2). As such, the robotic cleaning apparatus 200 may have improved cleaning performance, for example, adjacent obstacles and/or corners.

The antennas 204-1 and 204-2 can be configured such that, in response to engaging (e.g., contacting) an obstacle, the portion of the antennas 204-1 and 204-2 extending beyond the body 202 are urged under a portion of the body 202 (e.g., under the displaceable bumper 216). In other words, the antennas 204-1 and 204-2 are configured to deform in response to engaging (e.g., contacting) an obstacle such that, for example, the displaceable bumper 216 can engage the obstacle. As such, the antennas 204-1 and 204-2 may not include an obstacle detection sensor for detecting contact between the antennas 204-1 and 204-2 and an obstacle.

Figure 15:
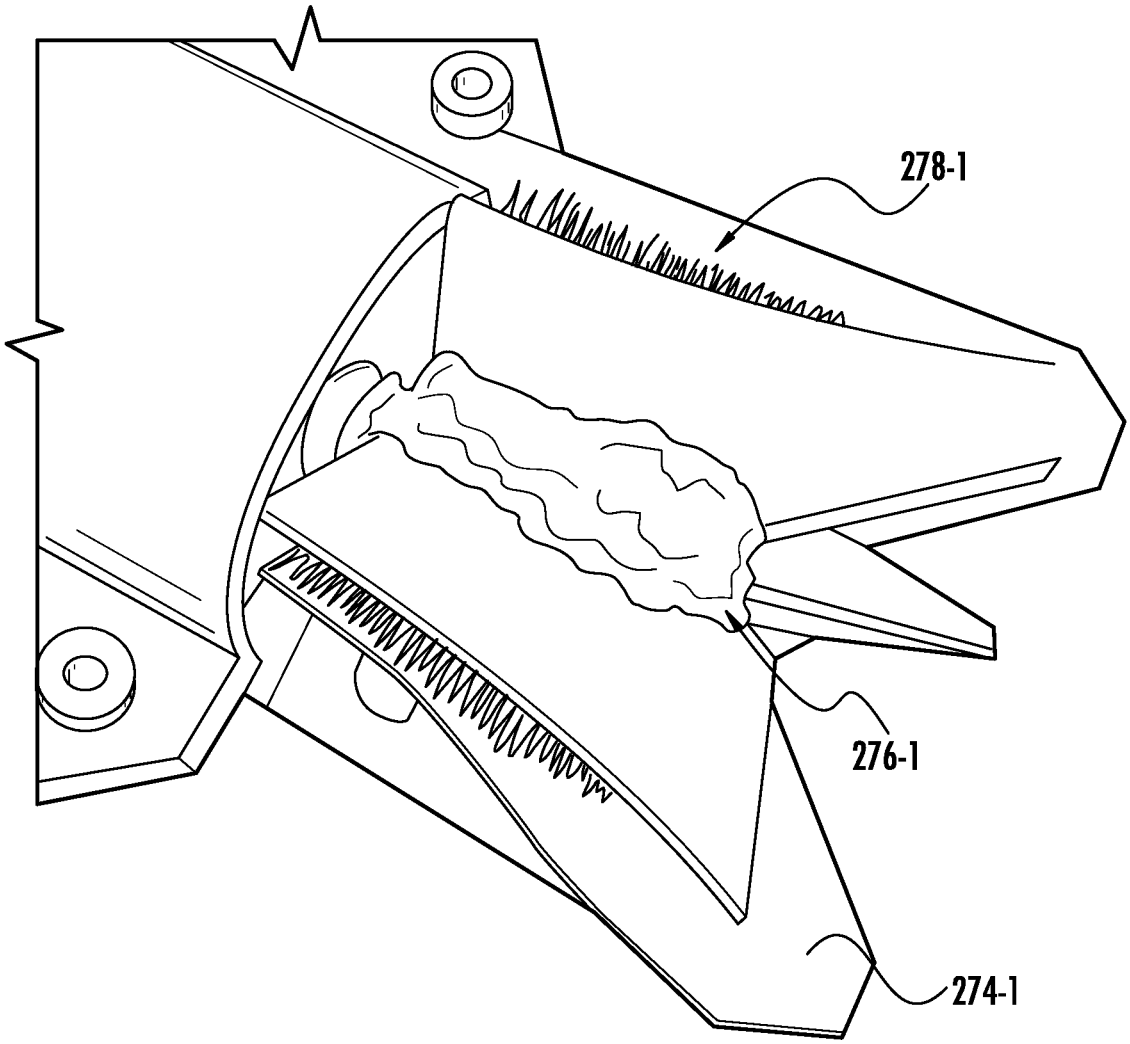
FIG. 15 is a perspective view of another example of an antenna capable of being used with the antenna assembly of FIG. 14, consistent with the present disclosure.

The antennas 204-1 and 204-2 can be made of a resiliently deformable material (e.g., natural rubber, synthetic rubber, and/or any other resiliently deformable material). For example, and as shown, the antennas 204-1 and 204-2 can include resiliently deformable fins 274-1 and 274-2 extending from a respective hub 276-1 and 276-2. Additionally, or alternatively, the antennas 204-1 and 204-2 include resiliently deformable bristles extending from a respective hub 276-1 and 276-2. For example, and as shown in FIG. 15, a strip of deformable bristles 278-1 can extend from the hub 276-1 and be positioned between a plurality of deformable fins 274-1.

Figure 16:
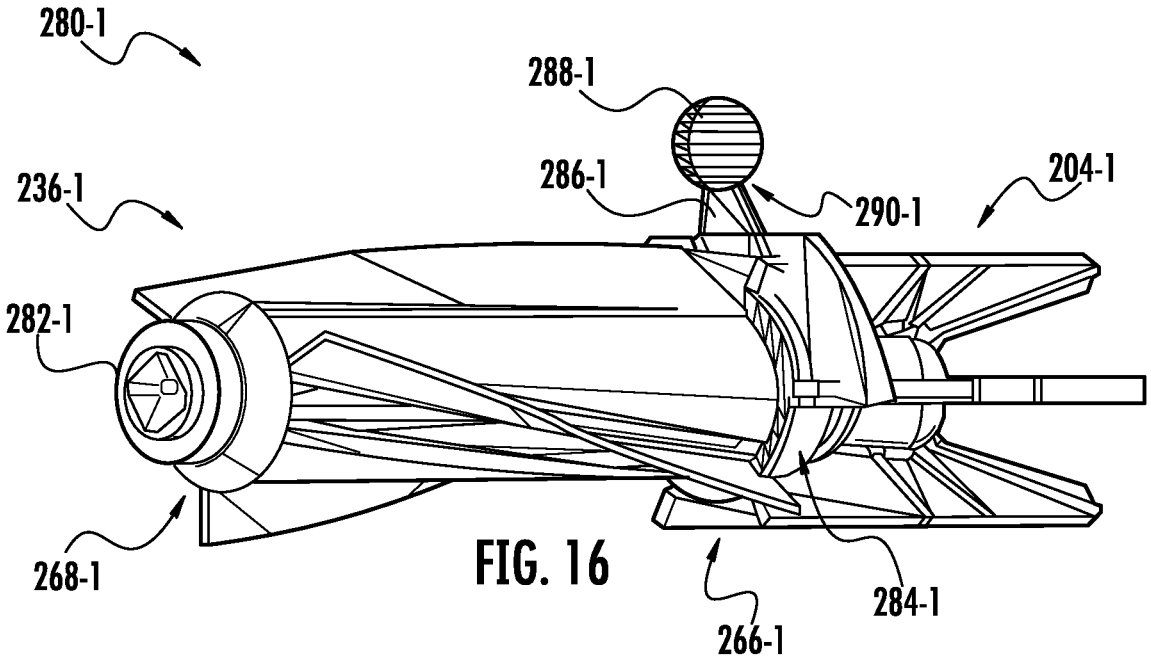
FIG. 16 is a perspective view of the antenna assembly of FIG. 13, consistent with the present disclosure.

FIG. 16 shows a perspective view of an antenna assembly 280-1 that includes the antenna 204-1 and the antenna agitator 236-1. As shown, the second distal end 268-1 includes a keyed hub 282-1 configured to couple the antenna agitator 236-1 to a motor such that the antenna 204-1 and antenna agitator 236-1 can be rotated with a drive shaft of the motor. A coupling 284-1 is proximate the first distal end 266-1 of the antenna agitator 236-1 (e.g., in an end region having a length measuring 5%, 10%, 25%, or 35% of an overall length of the antenna agitators 236-1 and 236-2). The coupling 284-1 can be configured to extend around at least a portion of the antenna agitator 236-1 and/or the antenna 204-1. The antenna agitator 236-1 and antenna 204-1 are configured to rotate relative to the coupling 284-1. For example, the coupling 284-1 may include one or more bearings (e.g., ball bearings, journal bearings, roller bearings, and/or any other bearing).

Figure 17:
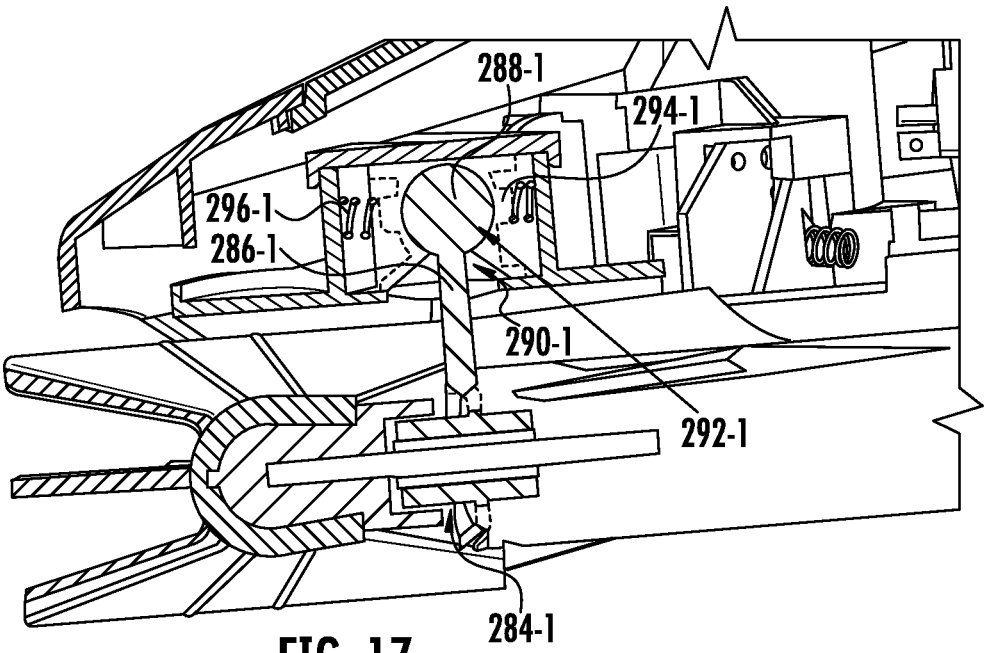
FIG. 17 is a perspective view of the antenna assembly of FIG. 13 removably coupled to the surface cleaning apparatus of FIG. 10, consistent with the present disclosure.

As shown, the coupling 284-1 includes a projection 286-1 having a ball 288-1 disposed on a distal end 290-1 of the projection 286-1. The ball 288-1 can be configured to be received in a corresponding receptacle 292-1 (e.g., as shown in FIG. 17) disposed within the body 202. The receptacle 292-1 can include jaws 294-1 configured to be biased in a direction of the ball 288-1 using, for example, springs 296-1. As such, the antenna assembly 280-1 can generally be described as being configured to be removable from the body 202 of the robotic cleaning apparatus 200 to, for example, be cleaned and/or replaced by a user.

Figure 18:
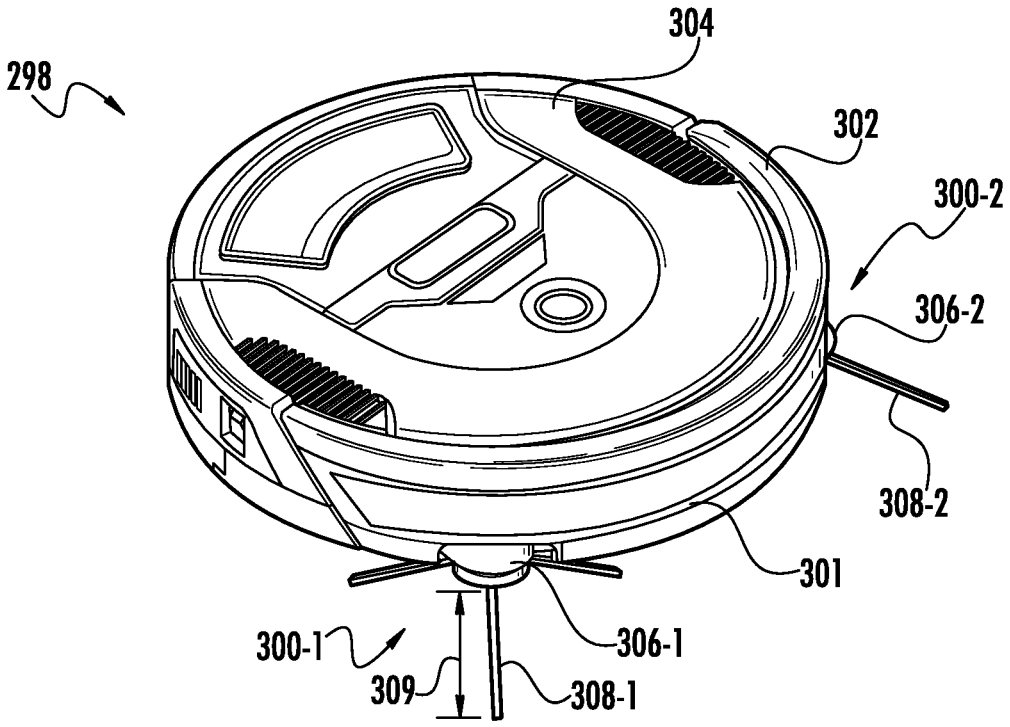
FIG. 18 is a perspective view of one embodiment of a surface cleaning apparatus having retractable side brushes, consistent with the present disclosure.
Figure 19:
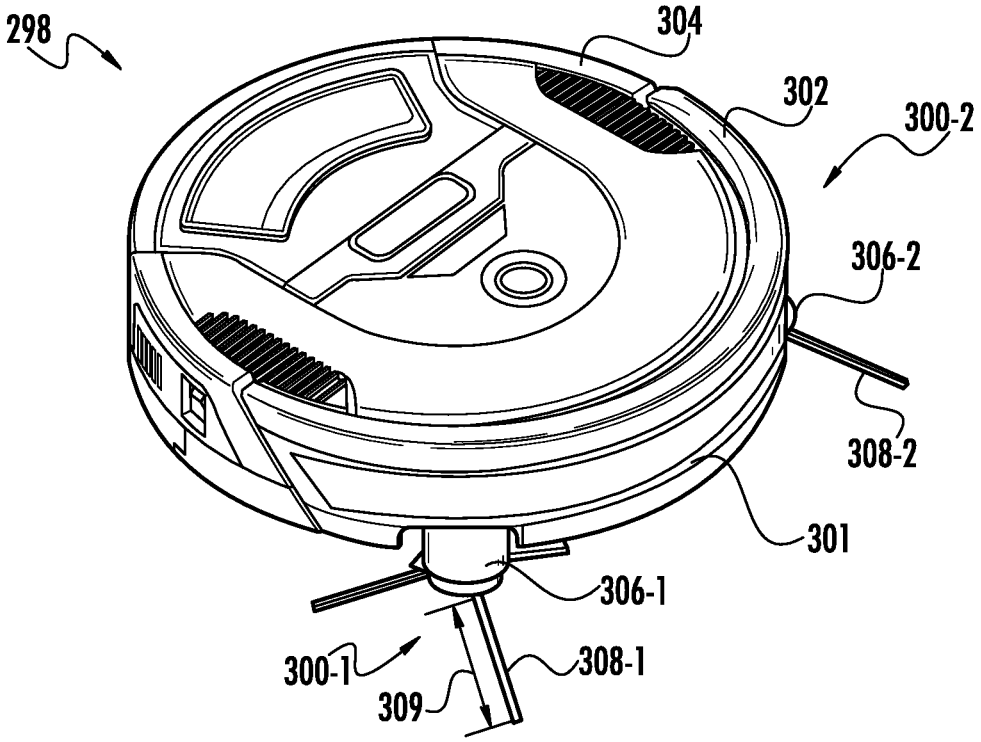
FIG. 19 is another perspective view of the surface cleaning apparatus of FIG. 18, consistent with the present disclosure.

FIGS. 18 and 19 show a perspective view of a robotic cleaning apparatus 298 having retractable side brushes 300-1 and 300-2. FIG. 18 shows the side brushes 300-1 and 300-2 in a retracted position and FIG. 19 shows the side brushes 300-1 and 300-2 in an extended position. As shown, the robotic cleaning apparatus 298 also includes a body 304. The body 304 includes a displaceable bumper 302 slideably coupled thereto.

The retractable side brushes 300-1 and 300-2 include hubs 306-1 and 306-2 having at least one bristle 308-1 and 308-2 extending therefrom. The hubs 306-1 and 306-2 are configured to rotate such that the bristles 308-1 and 308-2 rotate through a sweeping area. The size of the sweeping area may be based on a measure of a length 309 the bristles 308-1 and 308-2. For example, one or more of the hubs 306-1 and 306-2 can include at least two groups of the bristles 308-1 and 308-2, wherein at least one group of the bristles 308-1 and 308-2 has a length 309 that measures differently than a length 309 of at least one other group of the bristles 308-1 and 308-2. As shown, each hub 306-1 and 306-2 includes three groups of the bristles 308-1 and 308-2, each group having a length 309 that measures substantially the same.

The retractable side brushes 300-1 and 300-2 are configured to move inwards in a direction towards the body 304 when the robotic cleaning apparatus 298 engages (e.g., contacts) an obstacle. For example, the retractable side brushes 300-1 and 300-2 can be configured to retract within the body 304 a sufficient distance such that the hubs 306-1 and 306-2 do not extend substantially beyond the displaceable bumper 302. As such, the retractable side brushes 300-1 and 300-2 do not substantially interfere with the performance of the displaceable bumper 302.

Figure 20:
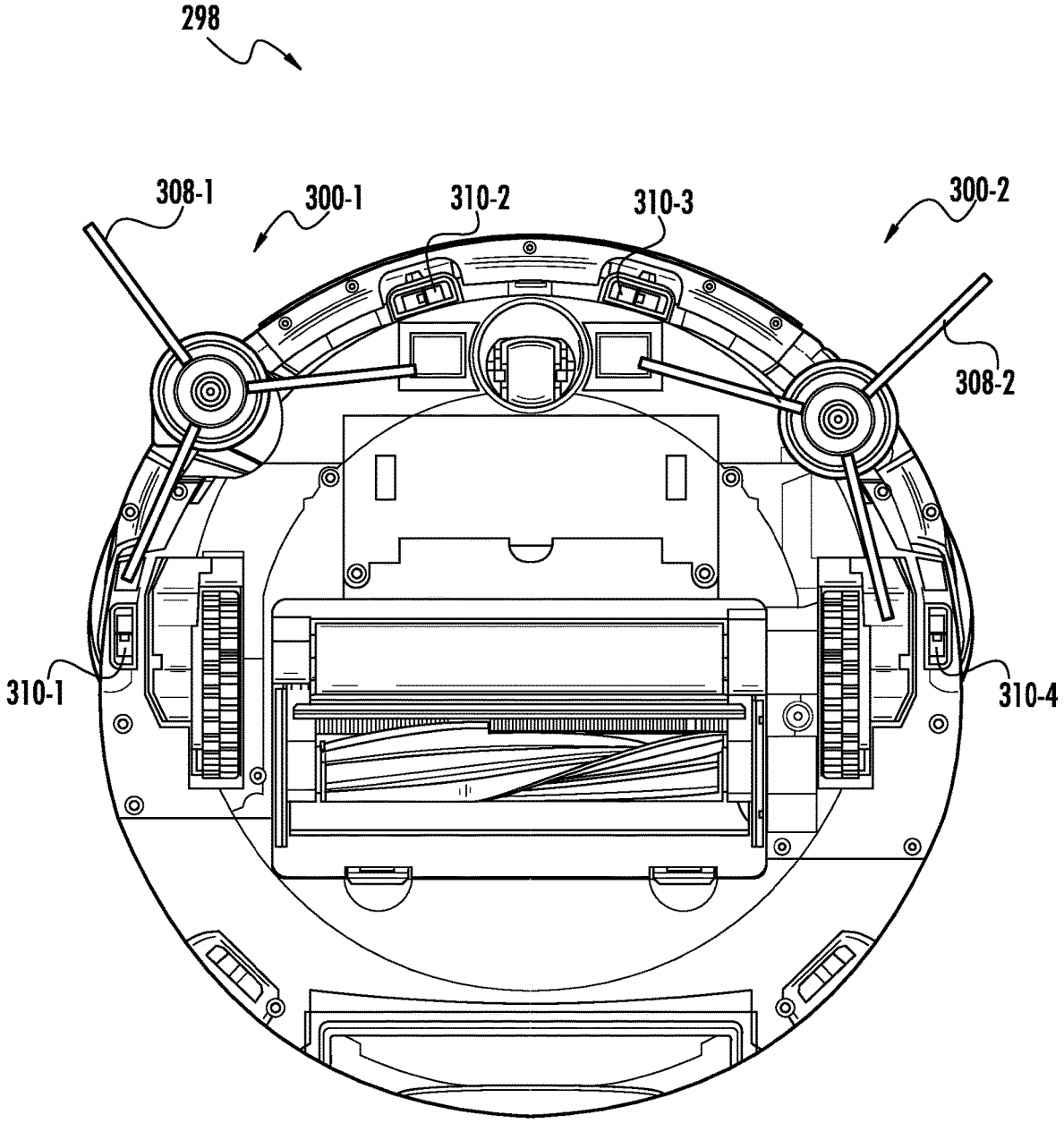
FIG. 20 is a bottom view of the surface cleaning apparatus of FIG. 18, consistent with the present disclosure.

FIG. 20 shows a bottom view of the robotic cleaning apparatus 298 having the retractable side brush 300-1 in an extended position and the retractable side brush 300-2 in a retracted position. When the retractable side brushes 300-1 and 300-2 are in either the retracted position or the extended position, the retractable side brushes 300-1 and 300-2 can be configured such that the bristles 308-1 and 308-2 do not pass between surface detection sensors 310-1 to 310-4 and a surface to be cleaned.

Figure 21:
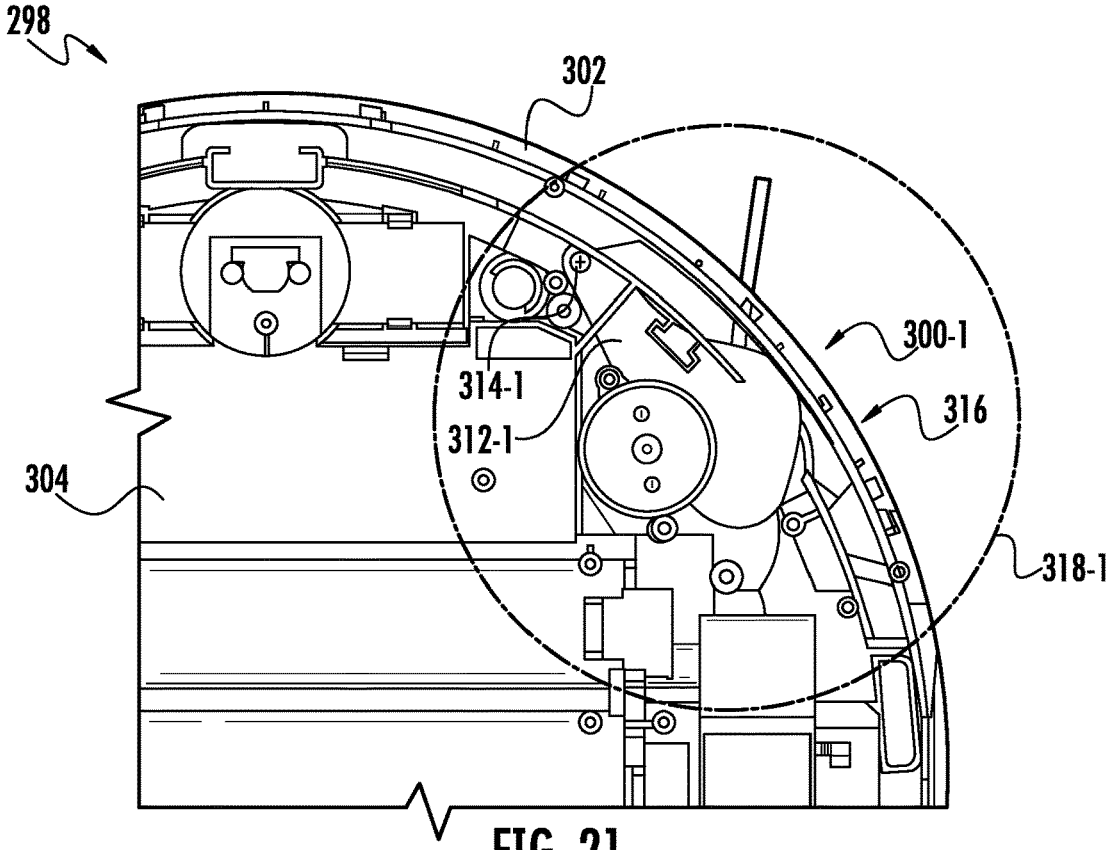
FIG. 21 is a cross-sectional view of the surface cleaning apparatus of FIG. 18, consistent with the present disclosure.
Figure 22:
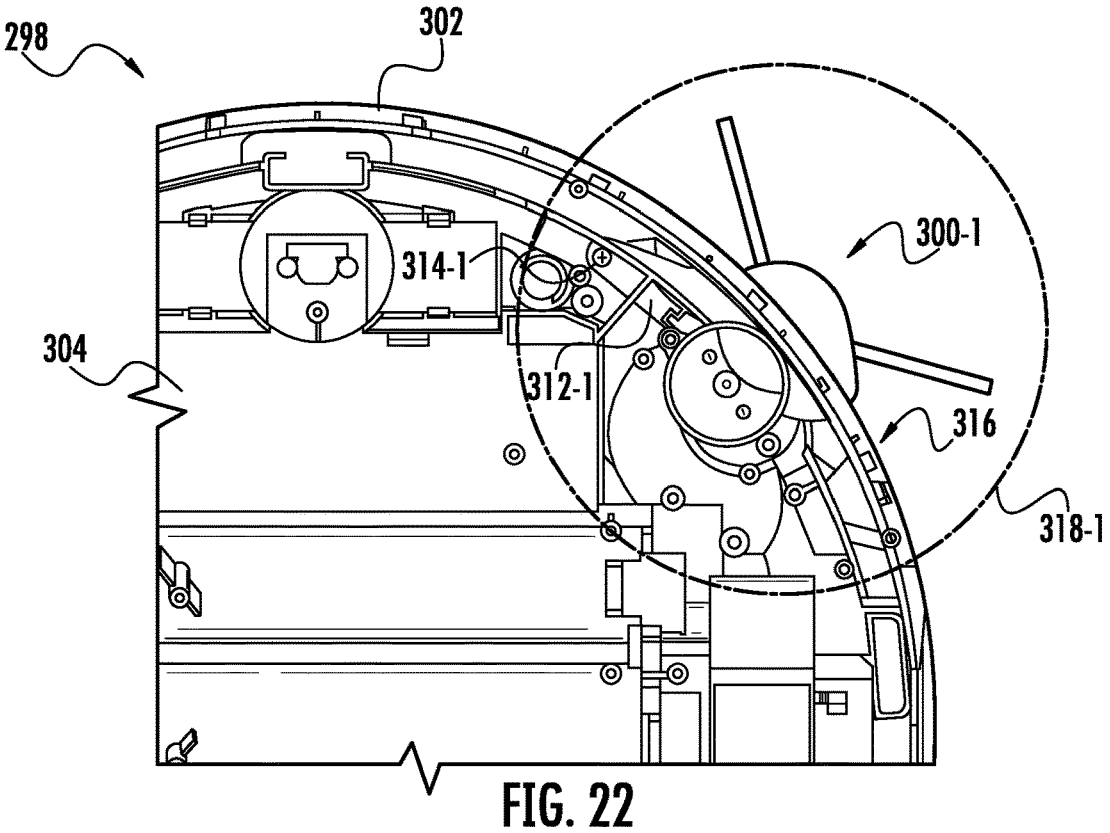
FIG. 22 is another cross-section view of the surface cleaning apparatus of FIG. 18, consistent with the present disclosure.

FIGS. 21 and 22 show a cross-sectional view of a forward portion of the robotic cleaning apparatus 298 showing the retractable side brush 300-1. FIG. 21 shows the retractable side brush 300-1 in the retracted position and FIG. 22 shows the retractable side brush 300-1 in the extended position. As shown, the portion of the retractable side brush 300-1 configured to extend beyond a periphery of the displaceable bumper 302 is disposed between at least a portion of the displaceable bumper 302 and a surface to be cleaned. For example, the portion of the retractable side brush 300-1 configured to extend beyond the periphery of the displaceable bumper 302 can be configured to extend between a surface to be cleaned and a sensor window 301 (see FIGS. 18-19) that is configured to allow, for example, one or more optical sensors transmit therethrough.

As shown, the retractable side brush 300-1 includes a pivot arm 312-1 pivotally coupled at a pivot point 314-1. The pivot arm 312-1 is configured to pivot about the pivot point 314-1 such that the side brush 300-1 transitions between the retracted and extended positions. A biasing mechanism can be provided that biases the side brush 300-1 towards the extended position. As such, when the retractable side brush 300-1 engages (e.g., contacts) an obstacle, the retractable side brush 300-1 is urged towards the retracted position (overcoming the biasing force). However, when the retractable side brush 300-1 comes out of engagement with the obstacle, the biasing mechanism urges the retractable side brush 300-1 towards the extended position. For example, the biasing mechanism may include a torsion spring positioned at the pivot point 314-1.

As also shown, when the retractable side brush 300-1 is in the retracted position, the hub 306-1 and pivot arm 312-1 are positioned behind an obstacle contacting surface 316 of the displaceable bumper 302. As such, the hub 306-1 and pivot arm 312-1 are prevented from substantially interfering with the performance of the displaceable bumper 302.

When the retractable side brush 300-1 is in the extended position a sweeping area 318-1 of the retractable side brush 300-1 that extends beyond the contacting surface 316 of the displaceable bumper 302 is greater than when the retractable side brush 300-1 is in the retracted position. As such, the retractable side brush 300-1 may be able to reach further into, for example, a corner defined by two or more obstacles (e.g., walls) when in the extended position. However, as shown, when the retractable side brush 300-1 is in the retracted position a portion of the sweeping area 318-1 can still extend beyond the contacting surface 316 of the displaceable bumper 302.

FIGS. 21 and 22 show the robotic cleaning apparatus 298 removed from a surface to be cleaned. As shown, the bristles 308-1 and 308-2 can be configured to be angled away from the body 304 such that, when the robotic cleaning apparatus 298 is placed on a surface to be cleaned, the bristles 308-1 and 308-2 are urged towards the body 304. As a result, the sweeping area 318-1 shown in FIGS. 21 and 22 is illustrative of a situation where the robotic cleaning apparatus 298 is disposed on a surface to be cleaned.

Figure 23:
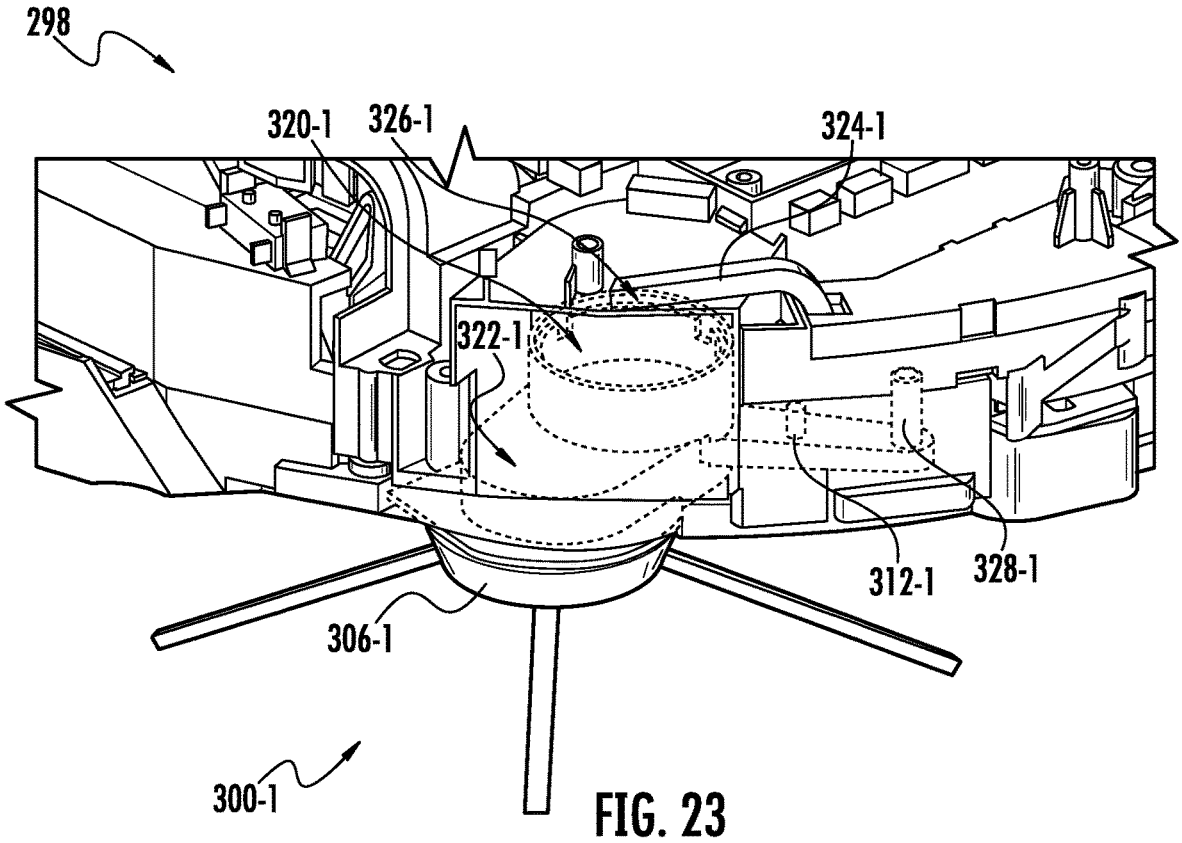
FIG. 23 is a perspective view of the surface cleaning apparatus of FIG. 18, consistent with the present disclosure.

FIG. 23 shows a perspective view of a portion of the robotic cleaning apparatus 298, wherein at least a portion of the robotic cleaning apparatus is shown as transparent for the purposes of illustrating the retractable side brush 300-1. As shown, the pivot arm 312-1 defines a motor cavity 320-1 configured to receive a motor for causing the hub 306-1 to rotate. A gear box housing 322-1 for receiving one or more gears can extend between the motor cavity 320-1 and the hub 306-1 such that the rotational motion of the drive shaft of the motor can be transmitted to the hub 306-1.

A pivot limiter 324-1 can slideably engage at least a portion of the pivot arm 312-1. The pivot limiter 324-1 can be configured to limit the pivotal motion of the pivot arm 312-1 about the pivot point 314-1. For example, and as shown, a portion of the pivot limiter 324-1 can extend at least partially into an opening 326-1 that extends into the motor cavity 320-1. Distal ends of the opening 326-1 can be configured to engage a portion of the pivot limiter 324-1 such that further pivotal movement of the pivot arm 312-1 beyond a predetermined position can be substantially prevented.

As shown, the pivot arm 312-1 includes a protrusion 328-1 extending therefrom at the pivot point 314-1. The protrusion 328-1 may be configured such that a torsion spring can extend therearound such that the torsion spring biases the pivot arm 312-1 towards the extended position.

Figure 24:
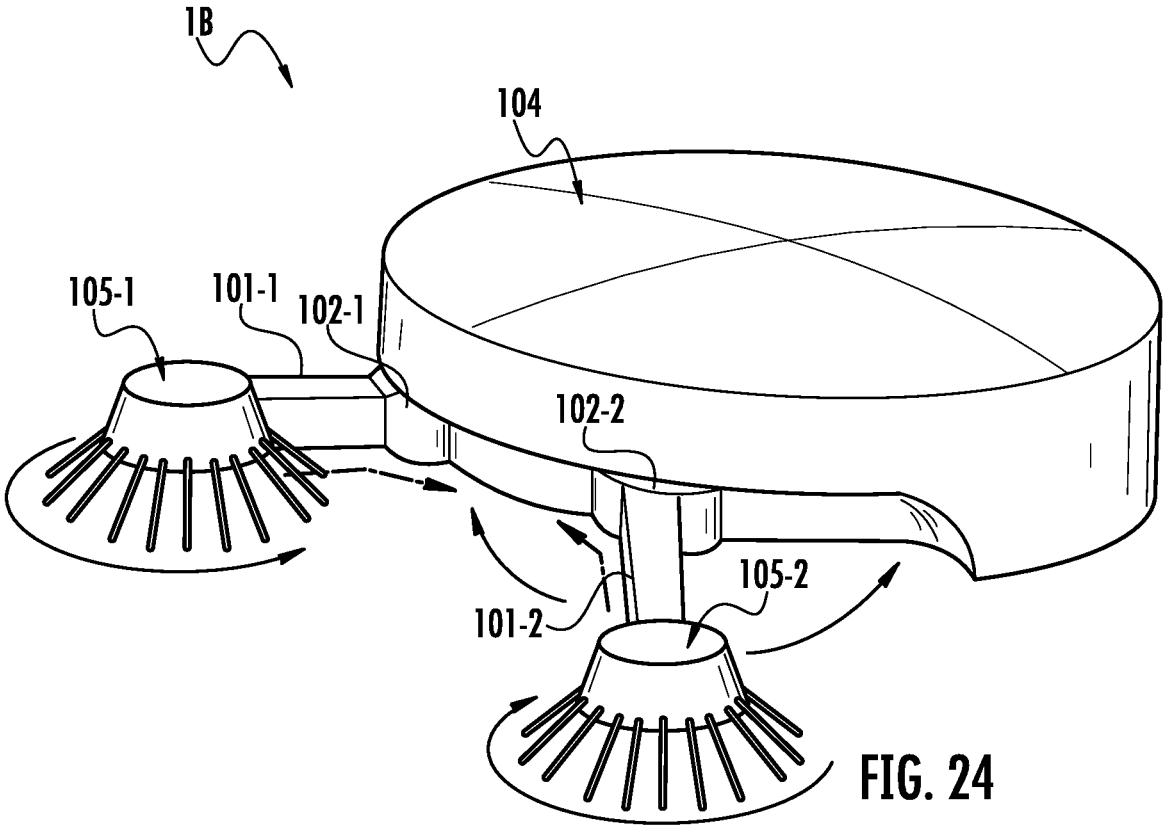
FIG. 24 is a perspective view of one embodiment of a surface cleaning apparatus having retractable brush arms, consistent with the present disclosure.

FIG. 24 shows a schematic view of an example embodiment of a robotic cleaning apparatus 1B in accordance with an embodiment of the present disclosure. As shown, the robotic cleaning apparatus 1B includes two arms, namely arm 101-1 and 101-2, although the robotic cleaning apparatus may have more or fewer arms. Each of the arms 101-1 and 101-2 include a distal end having cleaning devices (or brushes) 105-1 and 105-2, respectively. Each of the arms 101-1 and 101-2 include a proximal end 102-1 and 102-2, respectively, which rotatably couples to the housing 104. In some instances, for example, each of the arms 101-1 and 101-2 may rotate relative to the housing 104 in response to contacting obstacles. The arms 101-1 and 101-2 may also be configured such that a suction channel is defined therein such that a suction force can be generated at the brushes 105-1 and 105-2.

Figure 25:
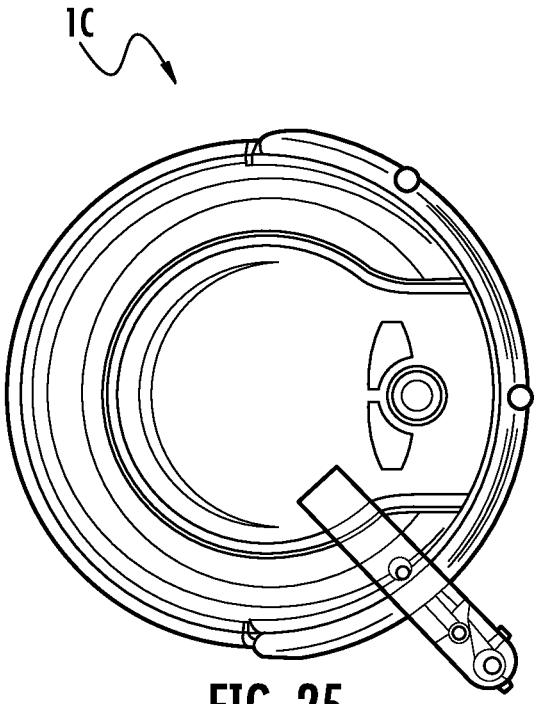
FIG. 25 is a top view of one embodiment of a surface cleaning apparatus having a vertically mounted cleaning device, consistent with the present disclosure.
Figure 26:
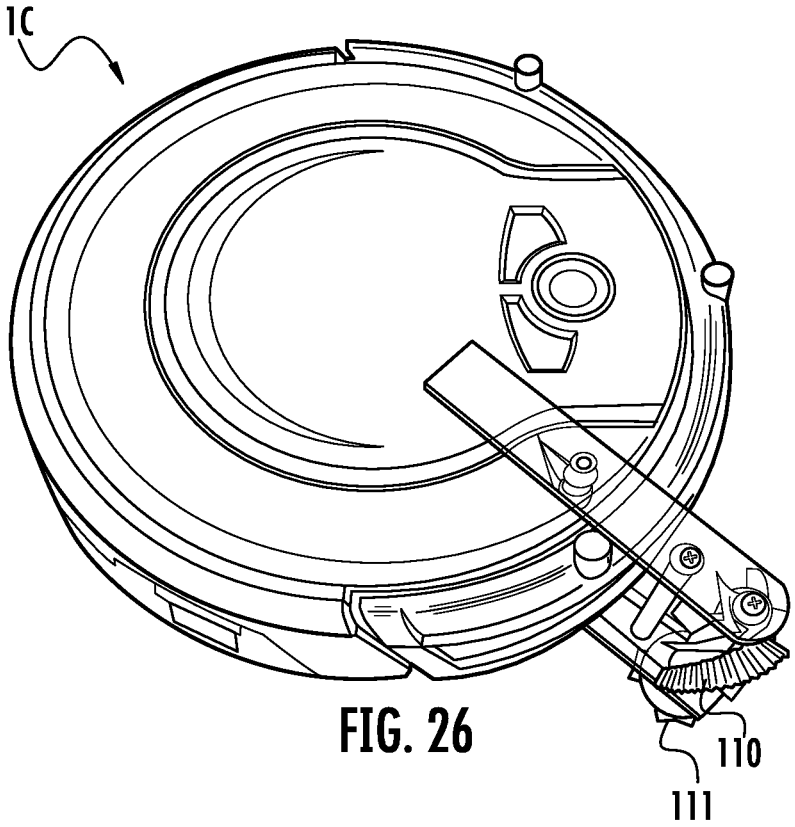
FIG. 26 is a perspective view of the surface cleaning apparatus of FIG. 25, in accordance with an embodiment of the present disclosure.

FIGS. 25 and 26 show another example embodiment of a robotic cleaning apparatus 1C in accordance with an embodiment of the present disclosure. As shown, the robotic cleaning apparatus 1C includes a vertically-mounted cleaning device 110. The vertically-mounted cleaning device 110 may include a helical brush, such as shown, although other embodiments are within the scope of this disclosure. As further shown, the robotic cleaning apparatus 1C may include a horizontal cleaning brush 111. The vertically-mounted cleaning device 110 and the horizontal cleaning brush 111 may be coaxial. The vertically-mounted cleaning device 110 may be configured to contact edge and corner surfaces for cleaning purposes. On the other hand, the horizontal cleaning brush 111 may be configured to contact horizontal surfaces (e.g., floors, rugs, and so on).

Figure 28:
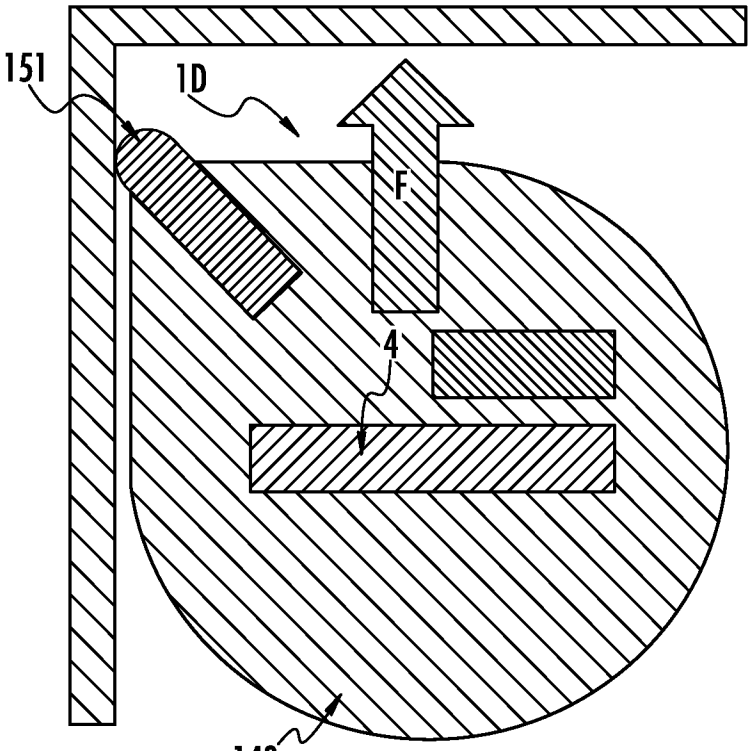
FIG. 28 is a bottom view of the surface cleaning apparatus of FIG. 27, consistent with the present disclosure.
Figure 27:
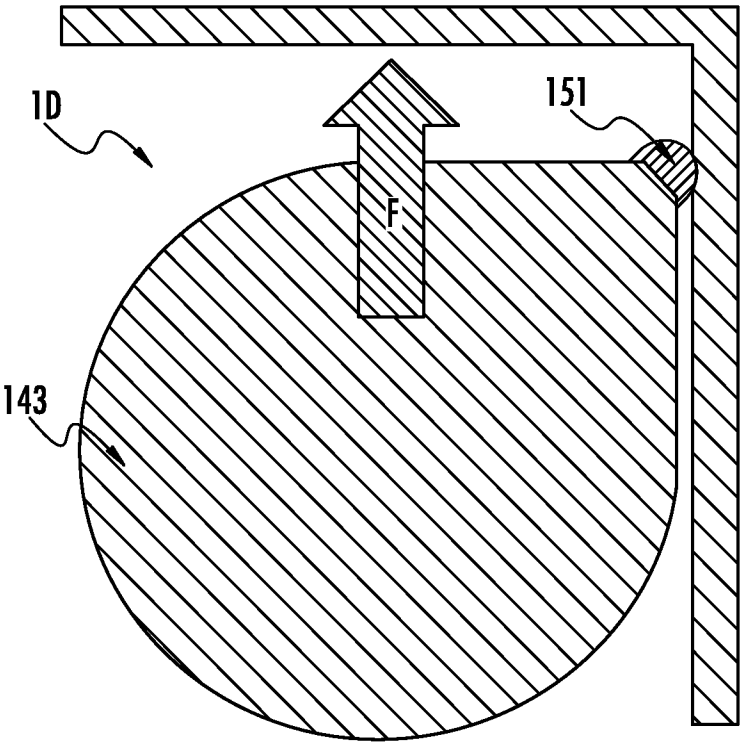
FIG. 27 is a top view of one embodiment of a surface cleaning apparatus having a tear drop shaped body, consistent with the present disclosure.

FIG. 27 shows a top view and FIG. 28 shows a bottom view of a schematic example of a robotic cleaning apparatus 1D in accordance with an embodiment of the present disclosure. As shown, the robotic cleaning apparatus 1D includes a tear drop shaped body 143. At a tip/narrow point of the body 143, a brush 151 may extend therefrom to make contact with edge and/or corner surfaces. The brush 151 can be configured to urge debris in a direction of forward movement of the robotic cleaning apparatus 1D such that the debris can be collected by the primary cleaning devices 4.

Figure 31:
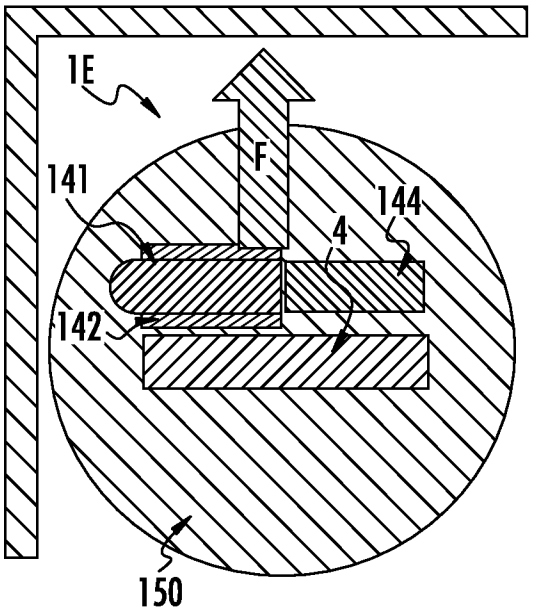
FIG. 31 is another bottom view of the surface cleaning apparatus of FIG. 29, consistent with the present disclosure.
Figure 30:
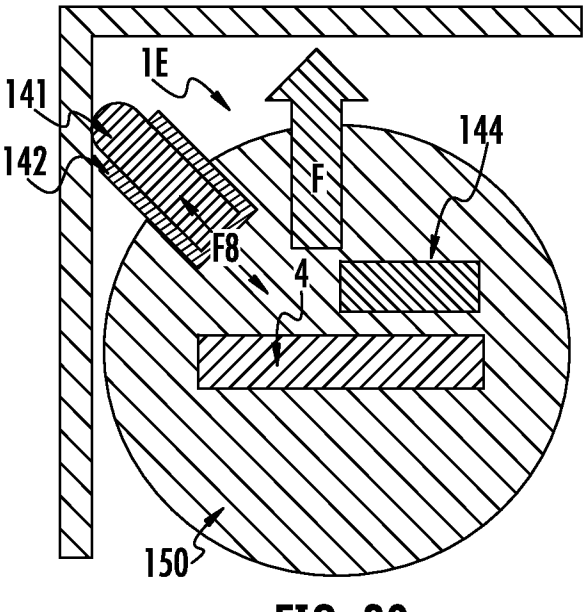
FIG. 30 is a bottom view of the surface cleaning apparatus of FIG. 29, consistent with the present disclosure.
Figure 29:
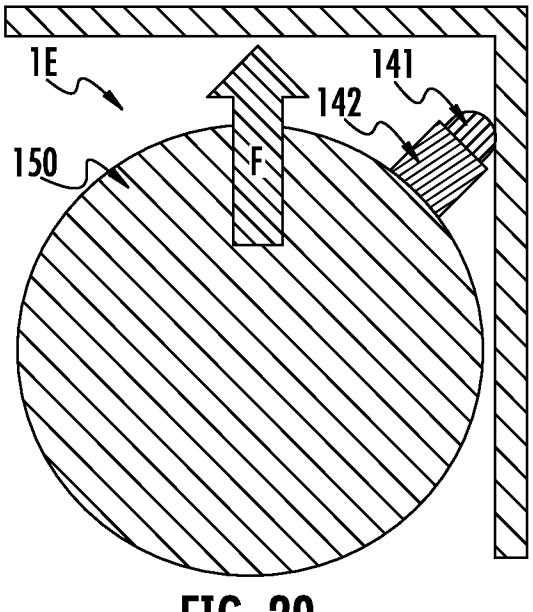
FIG. 29 is a top view of one embodiment of a surface cleaning apparatus having an extendible brush, consistent with the present disclosure.

FIG. 29 shows a top view, FIG. 30 shows a bottom view, and FIG. 31 shows a bottom view of an example of a robotic cleaning apparatus 1E in accordance with an embodiment of the present disclosure. As shown, the robotic cleaning apparatus 1E includes a round body 150. A brush housing 142 may be coupled to a bottom side of the round body 150. The brush housing 142 may be configured to receive and securely hold a brush 141. The brush housing 142 may then extend towards an edge surface and/or corner. The brush 141 may extend from the brush housing 142 to make contact with the edge/corner surface(s). The brush housing 142 may be extended when, for instance, sensory detects proximity of an edge/corner surface. Likewise, the brush housing 142 may be retracted when, for instance, sensory detects the absence of a vertical surface.

The position of brush housing 142 may be fixed. Alternatively, the brush housing 142 may retract and extend along path F8. The resting position of the brush housing 142 may bring the brush 141 substantially in parallel with a fixed brush 144. Thus, the brush 141 and the fixed brush 144 may form, essentially, a single cleaning element. The single cleaning element may form an integrated cleaning element with the primary cleaning device 4, as discussed above.

Figure 32:
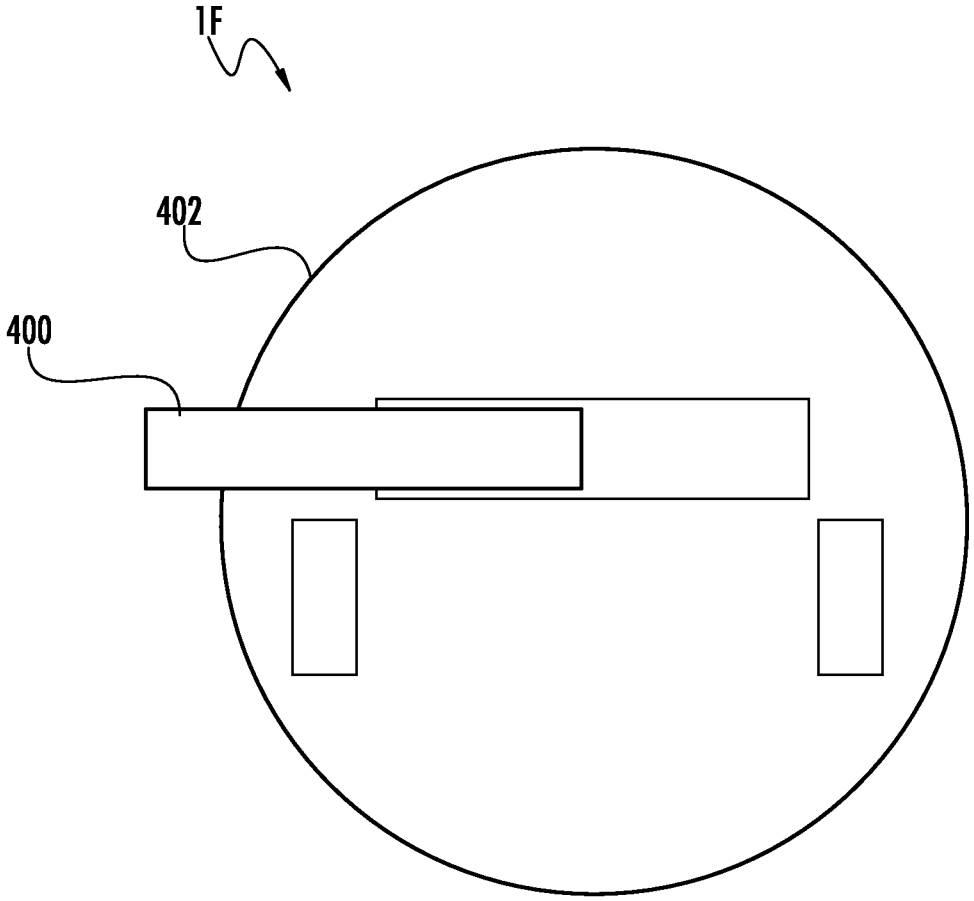
FIG. 32 is a schematic bottom view of one embodiment of a surface cleaning apparatus having an extendible suction channel, consistent with the present disclosure.

FIG. 32 shows a schematic example of a robotic cleaning apparatus 1F. As shown, the robotic cleaning apparatus 1F includes an extendable suction channel 400 configured to extend outwardly from a perimeter 402 of the robotic cleaning apparatus 1F. For example, the suction channel 400 can be configured to extend transverse (e.g., perpendicular) to a forward movement direction of the robotic cleaning apparatus 1F. As such, when the robotic cleaning apparatus 1F begins edge cleaning, the suction channel 400 can be extended and, when the robotic cleaning apparatus 1F begins room cleaning, the suction channel 400 can be retracted such that the overall footprint of the robotic cleaning apparatus 1F can be reduced.

In one aspect of the present disclosure, there is provided a robotic cleaning apparatus. The robotic cleaning apparatus can include a body and at least one antenna extending from a periphery of the body. The at least one antenna can be configured to rotate about an axis that extends substantially parallel to a surface to be cleaned.

In some instances, the robotic cleaning apparatus can include at least one antenna agitator. The antenna agitator can be coupled to the antenna such that the antenna agitator and the antenna are configured to rotate together. In some instances, the robotic cleaning apparatus can include at least two antennas and at least two antenna agitators. A rotational axis of one of the antenna agitators can extend transverse to a rotational axis of another of the antenna agitators. In some instances, the at least two antenna agitators and the at least two antennas can be configured to be counter rotating. In some instances, the at least one antenna can be resiliently deformable. In some instances, the robotic cleaning apparatus can include an agitator assembly comprising a first agitator and a second agitator. In some instances, the agitator assembly can include an agitator cover having a plurality of teeth configured to engage the second agitator. In some instances, the agitator cover can further include a first flexible strip and a second flexible strip. The first and second flexible strips can be disposed on opposing sides of the agitator cover.

In another aspect of the present disclosure, there is provided a robotic cleaning apparatus. The robotic cleaning apparatus can include a body, an agitator assembly, a first antenna assembly, and a second antenna assembly. The first antenna assembly can be removably coupled to the body. The first antenna assembly can include a first antenna agitator and a first antenna configured to rotate about a first rotation axis. The second antenna assembly can be removably coupled to the body. The second antenna assembly can include a second antenna agitator and a second antenna configured to rotate about a second rotation axis. The first rotation axis can extend transverse to the second rotation axis such that the first and second antenna assemblies are configured to cooperate to urge debris towards a movement path of the robotic cleaning apparatus.

In some instances, the first and second antennas are configured to extend beyond a periphery of the body. In some instances, the first rotation axis and the second rotation axis can extend substantially parallel to a surface to be cleaned and the first antenna and the first antenna agitator can be configured to rotate in a first direction about the first rotation axis and the second antenna and the second antenna agitator can be configured to rotate in a second direction about the second rotation axis, the first direction being opposite the second direction. In some instances, the first and second antennas can be resiliently deformable. In some instances, the agitator assembly can include a first assembly agitator and a second assembly agitator. In some instances, the agitator assembly can include an agitator cover having a plurality of teeth configured to engage the second assembly agitator. In some instances, the agitator cover can include a first flexible strip and a second flexible strip, the first and second flexible strips being disposed on opposing sides of the agitator cover. In some instances, the first and second agitator assemblies can each include a coupling for removably coupling the first and second agitator assemblies to the body. In some instances, each coupling can be configured such that the first and second antennas and antenna agitators rotate relative to the coupling. In some instances, each coupling can include a ball that is configured to be received within a receptacle within the body. In some instances, the robotic cleaning apparatus can include a first flexible strip extending between the first antenna assembly and the agitator assembly and a second flexible strip extending between the second antenna assembly and the agitator assembly. In some instances, the body can be substantially D-shaped.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention, which is not to be limited except by the claims.

What is claimed is:

1. A robotic cleaning apparatus comprising:

a body;

at least one antenna agitator configured to rotate about a rotation axis that extends substantially parallel to a surface to be cleaned; and at least one antenna extending from a distal end of a respective antenna agitator in a direction along the rotation axis, wherein at least a portion of the antenna extends from a periphery of the body.

2. The robotic cleaning apparatus of claim 1, further comprising at least two antennas and at least two antenna agitators, wherein a rotation axis of one of the antenna agitators extends transverse to a rotation axis of another of the antenna agitators.

3. The robotic cleaning apparatus of claim 2, wherein the at least two antenna agitators and the at least two antennas are configured to be counter rotating.

4. The robotic cleaning apparatus of claim 1, wherein the at least one antenna is resiliently deformable.

5. The robotic cleaning apparatus of claim 1 further comprising an agitator assembly comprising a first agitator and a second agitator.

6. The robotic cleaning apparatus of claim 5, wherein the agitator assembly further comprises an agitator cover having a plurality of teeth configured to engage the second agitator.

7. The robotic cleaning apparatus of claim 6, wherein the agitator cover further comprises a first flexible strip and a second flexible strip, the first and second flexible strips being disposed on opposing sides of the agitator cover.

8. A robotic cleaning apparatus comprising:

a body;

an agitator assembly;

a first antenna assembly removably coupled to the body, the first antenna assembly including a first antenna agitator configured to rotate about a first rotation axis that extends substantially parallel to a surface to be cleaned and a first antenna extending from a first agitator distal end of the first antenna agitator in a direction along the first rotation axis, wherein at least a portion of the first antenna extends from a periphery of the body; and a second antenna assembly removably coupled to the body, the second antenna assembly including a second antenna agitator configured to rotate about a second rotation axis that extends substantially parallel to a surface to be cleaned and a second antenna extending from a second agitator distal end of the second antenna agitator in a direction along the second rotation axis, wherein at least a portion of the second antenna extends from the periphery of the body and wherein, the first rotation axis extends transverse to the second rotation axis such that the first and second antenna assemblies are configured to cooperate to urge debris towards a movement path of the robotic cleaning apparatus.

9. The robotic cleaning apparatus of claim 8, wherein the first antenna and the first antenna agitator are configured to rotate in a first direction about the first rotation axis and the second antenna and the second antenna agitator are configured to rotate in a second direction about the second rotation axis, the first direction being opposite the second direction.

10. The robotic cleaning apparatus of claim 8, wherein the first and second antennas are resiliently deformable.

11. The robotic cleaning apparatus of claim 8, wherein the agitator assembly includes a first assembly agitator and a second assembly agitator.

12. The robotic cleaning apparatus of claim 11, wherein the agitator assembly further comprises an agitator cover having a plurality of teeth configured to engage the second assembly agitator.

13. The robotic cleaning apparatus of claim 12, wherein the agitator cover further comprises a first flexible strip and a second flexible strip, the first and second flexible strips being disposed on opposing sides of the agitator cover.

14. The robotic cleaning apparatus of claim 8, wherein the first antenna assembly and the second antenna assembly each include a coupling for removably coupling the first antenna assembly and the second antenna assembly to the body.

15. The robotic cleaning apparatus of claim 14, wherein each coupling is configured such that the first and second antennas and antenna agitators rotate relative to the coupling.

16. The robotic cleaning apparatus of claim 15, wherein each coupling further comprises a ball configured to be received within a receptacle within the body.

17. The robotic cleaning apparatus of claim 8 further comprising a first flexible strip extending between the first antenna assembly and the agitator assembly and a second flexible strip extending between the second antenna assembly and the agitator assembly.

18. The robotic cleaning apparatus of claim 8, wherein the body is substantially D-shaped.

* * * * *